US008011409B2

(12) United States Patent
Adami

(10) Patent No.: US 8,011,409 B2
(45) Date of Patent: Sep. 6, 2011

(54) SPLICING DEVICE TO JOIN TOGETHER TWO WEB MATERIALS, UNWINDING DEVICE COMPRISING SAID SPLICING DEVICE

(75) Inventor: Mauro Adami, Lucca (IT)

(73) Assignee: Fosber S.p.A., Monsagrati Pescaglia, Lucca (IT)

( * ) Notice: Subject to any disclaimer, the term of this patent is extended or adjusted under 35 U.S.C. 154(b) by 6 days.

(21) Appl. No.: 12/232,705

(22) Filed: Sep. 23, 2008

(65) Prior Publication Data

US 2009/0071607 A1 Mar. 19, 2009

Related U.S. Application Data

(62) Division of application No. 11/135,375, filed on May 24, 2005, now Pat. No. 7,441,579.

(30) Foreign Application Priority Data

Jun. 18, 2004 (EP) ..... 04425447

(51) Int. Cl.
*B65H 21/00* (2006.01)
*B65H 19/18* (2006.01)

(52) U.S. Cl. ..... 156/504; 156/159; 156/502; 156/507; 242/552

(58) Field of Classification Search ..... 156/157, 156/159, 502, 504, 505, 507; 242/551, 552, 242/556

See application file for complete search history.

(56) References Cited

U.S. PATENT DOCUMENTS

| | | | | |
|---|---|---|---|---|
| 3,858,819 | A * | 1/1975 | Butler, Jr. | 242/552 |
| 4,564,413 | A * | 1/1986 | Murakami | 156/504 |
| 5,171,396 | A * | 12/1992 | Rank et al. | 156/502 |
| 6,786,264 | B1 * | 9/2004 | Torres Martinez | 156/504 |
| 2004/0084133 | A1 * | 5/2004 | Adami | 156/159 |

FOREIGN PATENT DOCUMENTS

EP 1348658 A1 * 10/2003

* cited by examiner

*Primary Examiner* — Mark A Osele
(74) *Attorney, Agent, or Firm* — Breiner & Breiner, L.L.C.

(57) ABSTRACT

A splicing device to join a first web material coming from a reel being fed (BA), to a second web material (NB), coming from a reel standing by (BB), comprising two heads (107A, 127A; 107B, 127B), each of which comprises: a roller (129A; 129B) associated with a clamping bar (143A, 145A; 143B, 145B) to hold an initial edge of the second web material (NB); a counter-pressure member (109A; 109B) cooperating with said roller (129A; 129B) to press said first and second web material (NA, NB) against each other; a cutting member (111A; 111B); a moving unit (113A; 113B), on which said counter-pressure member (109A; 109B) and said cutting member (111A; 111B) are carried. A first common control member (121) is provided to cause, by the movement it imparts to the moving unit of one or other head alternately: pinching of the first and second web material between the roller (129A; 129B) and the counter-pressure member (109A; 109B); cutting of the first web material; and release of the second web material.

5 Claims, 22 Drawing Sheets

SPLICING DEVICE TO JOIN TOGETHER TWO WEB MATERIALS, UNWINDING DEVICE COMPRISING SAID SPLICING DEVICE

This application is a division of Ser. No. 11/135,375 filed May 24, 2005, now U.S. Pat. No. 7,441,579 B2.

TECHNICAL FIELD

The present invention relates to a device to join together two webs, for example two sheets of cardboard, to allow continuous feed of a web material wound in reels towards a processing line, for example a machine for producing corrugated cardboard.

The invention also relates to an unwinding device, in which reels of web material are unwound in succession, provided with a splicing device to join a first web material coming from a reel being unwound to the head or initial edge of a second web material coming from a reel standing by.

STATE OF THE ART

In many industrial applications, for example, although not exclusively, in the production of corrugated cardboard, a web material from a reel being unwound is fed towards a production line. In the case of corrugated cardboard, for example, the web material is fed to a "single facer" or to a "double facer" to be coupled with other sheets of web material, if necessary after corrugation thereof.

To obtain continuous operation of the production line to which the web material is fed, the web material from a first reel must be joined to the web material from a second reel, for example when the first reel is about to terminate. This operation must take place preferably without reducing the feed speed of the material to the production line and in any case without stopping feed. The regularity of feed is particularly important in corrugated cardboard production lines, where the machines downstream of the unwinding device operate at high temperature and wherein feed speed and regularity are critical parameters for obtaining a high quality end product.

In order to join sheets of web material together in a rapid and reliable way, various devices have been produced.

U.S. Pat. No. 3,858,819 describes a device provided with two bars movable transversely with respect to the direction of feed of the web material and on which the initial free edge of the web material of an extra reel standing by is alternatively fixed. Provided under the two bars is a double counter-blade cooperating alternately with two cutting blades. A first actuator for each assembly formed by bar and cutting blade causes a reciprocal movement to draw the bars towards each other to press the two web materials to be spliced against each other. Two actuators are also provided, one for each cutting blade, which are operated alternately to cut the web material that is about to terminate.

The device described in U.S. Pat. No. 3,858,819 is complex and is unable to reach the high operating speeds currently required for these devices.

A similar device, with analogous problems and limits, is described in EP-B-0.378.721.

GB-A-1.569.886 describes a splicing device wherein the two web materials are spliced by reciprocal pressure between two rollers, with which a cutting blade is associated. This device is also complex due to the need to provide several actuators to control the various members of the splicing device. The speeds that can be reached are limited.

A more efficient and simpler splicing device is described in EP-A-1.422.175. This describes a splicing device with two heads, each of which comprises: a roller associated with a clamping bar to hold an initial edge of the second web material between said roller and said clamping bar; a counter-pressure member cooperating with said roller to press said first and second web material against each other; a cutting member; if necessary a braking means to brake the first web material. The counter-pressure member, the cutting member and the braking means, if provided, are carried by a moving unit controlled by an actuator which, through the movement it imparts to said unit, causes any braking of the first web material by said braking means, pinching of the first and second web material between said roller and said counter-pressure member, cutting of the first web material by said cutting member and release of the second web material by a movement of said roller with respect to said clamping bar, the roller being pushed by said counter-pressure member.

This splicing device overcomes the drawbacks of traditional splicing devices, is particularly reliable even at high speeds and has a simple structure.

OBJECTS AND SUMMARY OF THE INVENTION

The object of the present invention is to produce a splicing device that, starting from the description in EP-A-1.422.175, obtains further advantages in terms of efficiency and constructional simplicity.

Essentially, according to a first aspect the invention relates to a splicing device with two heads, each of which comprises: a roller associated with a clamping bar to hold, between the roller and the clamping bar, an initial edge of a second web material that must be spliced to a first material; a counter-pressure member cooperating with the roller to press said first and second web material against each other; a cutting member; a moving unit, on which the counter-pressure member and the cutting member are carried. Characteristically, a first common control member is provided to operate the splicing device, which, by the movement it imparts alternately to the moving unit of one or other head, causes: pinching of the first and second web material between the roller and the counter-pressure member, cutting of the first web material, and release of the second web material. Moreover, according to a particularly advantageous embodiment of the invention, an arrangement of stops are provided, acting selectively on one or other of the moving units to block one of the two heads, which is to remain deactivated The use of a common control member makes it possible to produce an essentially symmetrical splicing device, that is, with two upper half-heads disposed symmetrically with respect to a common axis of oscillation for the two moving units carrying the cutting members. The two lower half-heads, cooperating with the upper half-heads may also be produced symmetrically to each other. The splicing device may have a configuration wherein the lower half-heads are fixed and the upper half-heads are moving on a common carriage or slide. However, in a particular embodiment the lower half-heads are carried by slides integral with arms for supporting and handling the reels.

The moving units may have an oscillating movement about their own axes. Advantageously, the two axes of oscillation may coincide.

In a possible embodiment a braking means of the web material is provided for each head. The two braking means may be operated by a second control unit common to the two heads.

Further advantageous characteristics and embodiments of the invention are indicated in the appended dependent claims.

According to a different aspect, the invention relates to a splicing device with two heads, each of which comprises: a roller associated with a clamping bar to hold an initial edge of the second web material; a counter-pressure member cooperating with said roller to press said first and second web material against each other; a cutting member; a moving unit, oscillating about an axis, on which said counter-pressure member and said cuffing member are carried; wherein control members cause, by the movement they impart to the moving unit alternately of one or other head: pinching of the first and second web material between the roller and the counter-pressure member; cutting of the first web material; and release of the second web material; characterized in that the two moving units of the two heads are disposed essentially symmetrically with respect to a plane of symmetry. Advantageously, according to a particular configuration, the two moving units of the two heads oscillate about a common axis, lying on the plane of symmetry. Preferably, each moving unit extends from the axis of oscillation extending away from said plane of symmetry, the counter-pressure member and the cutting member being positioned at a greater distance from the plane of symmetry with respect to the axis of oscillation.

According to a further aspect of the present invention, to obtain a symmetrical configuration also of the lower half-heads of the splicing device, advantageously—in a preferred configuration of the embodiment—the rollers of the two half-heads and the clamping bars associated therewith are disposed according to symmetrical arrangements on two supports, which may be fixed or moving according to the configuration of the unwinding device in which the splicing device is inserted.

A further object of the invention is also an unwinding device that has a splicing device of the aforesaid type.

BRIEF DESCRIPTION OF THE DRAWINGS

The finding shall be better understood following the description and accompanying drawing which show a non-limiting practical embodiment of the invention. More specifically, in the drawing.

DETAILED DESCRIPTION OF A PREFERRED EMBODIMENT OF THE INVENTION

Figure 1:
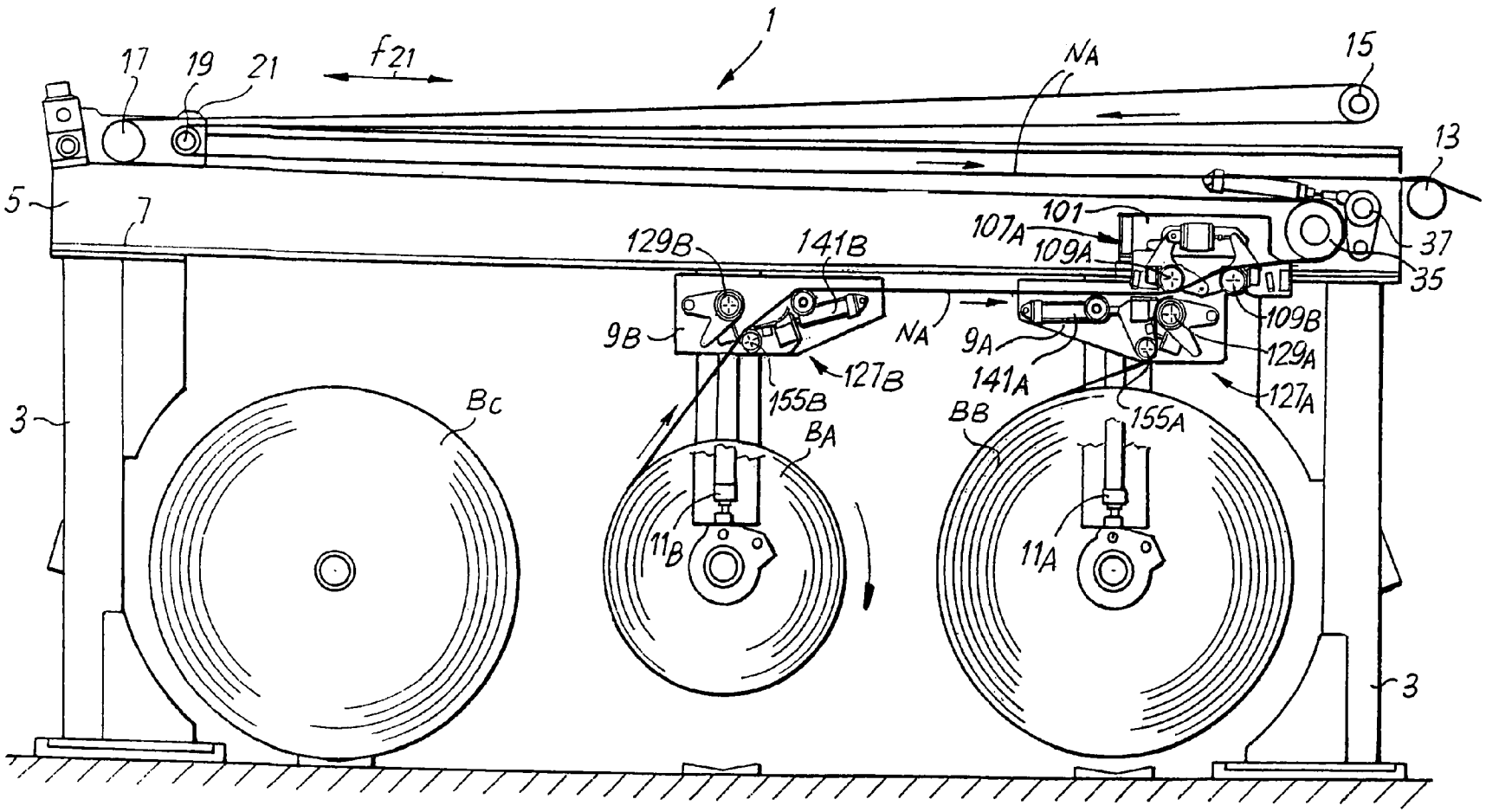
FIGS. 1 to 4 show an operating sequence of an unwinding device with moving arms and three stations for loading, unwinding and unloading the reels, equipped with a splicing device according to the invention.

FIGS. 1 to 4 show, in different operating steps, an unwinding device to feed a web material to a processing line downstream, not shown. A splicing device according to the invention is combined with the unwinding device. The unwinding device may typically be inserted in a production line for corrugated cardboard, and the reels unwound thereby may be reels of sheets of cardboard forming the components of the corrugated cardboard.

The structure of the unwinding device, indicated as a whole with 1, may vary with respect to what is shown, the splicing device of the invention also being suitable to be applied to unwinding devices differing in arrangement. The unwinding device shown herein is of the type described in greater detail in EP-A-1348658.

In the example illustrated, the unwinding device has a fixed structure with two pairs of uprights 3 (a single upright of each pair being visible in the drawing) and a pair of crosspieces 5 (one of which is visible in the drawing while the other is disposed behind it). The crosspieces 5 carry guides 7 for a pair of carriages or slides 9A and 9B. Each carriage 9A, 9B has engaging and lifting means 11A and 11B to engage and lift or lower reels (BA, BB, BC; BD) of web material. In the example shown these means have vertical arms that extend telescopically with tailstocks that engage each reel axially penetrating from opposite sides of the winding core. The structure of the carriages or slides 9A, 9B and the means 11A, 11B for lifting and lowering the reels is per se known and may vary with respect to what is shown schematically herein and is not the specific object of the present invention. Therefore, it shall not be described in detail herein. Greater details of a possible embodiment are described in EP-A-1348658.

It must be understood, as indicated above, that the structure of the unwinding device may also differ from the one illustrated; for example the reels may be handled by oscillating arms, in a per se known way. Moreover, the number of positions of the reels on the unwinding device may differ from three, as in the example shown. For example, there may only be two reel loading, unloading and processing stations or positions. A simplified embodiment of this type will be described briefly with reference to FIG. 12. As a non-limiting example, unwinding devices with different structures in which a splicing device according to the invention may be applied are described for example in EP-A-1127820, U.S. Pat. No. 3,858,819, JP-A-7157156, JP-A-1111749, EP-A-968945, U.S. Pat. No. 4,919,353 and U.S. Pat. No. 5,004,173.

The crosspieces 5 have at the top an assembly of rollers defining a supply or festoon of web material for the purposes described hereunder. This assembly of rollers comprises (in the example shown) a first fixed roller 13 and a second fixed roller 15, and a pair of rollers 17 and 19 with moving axes, carried by a carriage 21 sliding according to the arrow f21 along a guide 23 carried by the crosspieces 25.

With reference now to FIG. 1, in the phase of operation illustrated here, three reels, indicated with BA, BB and BC, are located on the unwinding device. The reel BA is in an intermediate position, carried by means 11B associated with the slide 9B. The reel BA is the one that supplies the web material, indicated with NA, towards the processing line downstream (not shown) during the phase shown in FIG. 1. The web material NA is driven around a motorized drive roller 35 against which a pressure roller 37 can press, through the effect of the action of a piston cylinder actuator. The purpose of the roller 35 is to accelerate the web material in the transitory phases to start feed from a new reel, as shall be better explained hereunder, and the pressure roller 37 prevents slipping between the web material and the accelerator roller 35. The pressure roller 37 could also be omitted.

Downstream of the roller 35 the web material forms a festoon being driven around the rollers 15, 17 and 19.

The reel BB is engaged by means 11A associated with the slide 9A. The initial edge of the web material NB wound around said reel BB is prepared by the operator and fixed to a clamping bar of a half-head of the splicing device to be subsequently carried to the position to be spliced to the tail portion of the web material NA coming from the reel BA in the phase to replace the reel BA with the reel BB. The latter will start to unwind when the reel BA terminates or in any case when it requires to be replaced, for example when there is a change in the order.

BC indicates a third reel standing by which will start to be used in place of the reel BB in a subsequent processing phase.

The splicing device, which forms the specific object of the present invention, comprises two heads each of which is formed of two portions or half-heads, the operation of which shall be described in greater detail hereunder.

In general terms, the splicing device comprises (see FIGS. 5, 6, 7A, 10, 11) a carriage 101 moving along the crosspieces 5. Movement is obtained by a rack and pinion transmission 103, 105, the rack 105 of which is associated with the two opposed and parallel crosspieces 5. The pinions are operated by means of a shaft 102 by a geared motor 104 carried by the carriage 101 (FIG. 6). Further idle guide pinions 106 are provided on each side of the carriage 101.

The first half-heads of the two heads of the splicing device are disposed on the carriage 101. The first half-head, indicated as a whole with 107A, comprises a counter-pressure member 109A, constituted in this example by a roller idly mounted on an axis of rotation 110A. A cutting member constituted by a blade 111A is associated with the counter-pressure member 109A. The counter-pressure member 109A and the cutting member 111A are carried by a moving unit constituted by a pair of sides 113A joined by a crosspiece 112A and oscillating about an axis A-A orthogonal to the direction of translation of the carriage 101. Therefore, oscillation of the sides 113A causes oscillation both of the counter-pressure member 109A, and of the cutting member 111A. As can be seen in particular in FIG. 5, the configuration of the two upper half-heads 107A, 107B is symmetrical with respect to a vertical plane (in the drawing) passing through the axis A-A.

An arm 114A, formed by two sides 115A joined by a crosspiece 117A, oscillates about an axis AA-AA carried by the sides 113A. A pad, made of rubber or another yielding material, indicated with 119A, is fitted on said arm 114A. The arm 114A with the pad 119A forms a braking means to brake the web material during splicing, as shall be explained hereunder.

The second half-head belonging to the second head of the splicing device, essentially specular to the half-head 107A, is constituted by members essentially equivalent to those described with reference to the half-head 107A, and distinguished in FIGS. 5, 7A-7I, 10 and 11 with the same reference numbers, followed by the letter B rather than the letter A.

The two moving units 113A and 113B formed by the two sides carrying the cutting members 111A, 111B and the counter-pressure members 109A, 109B are, therefore, hinged on the common axis A-A. Moreover, they are connected to each other by a common piston-cylinder control member, comprising one or more hydraulic or pneumatic piston cylinder actuators in parallel with each other. In FIGS. 5, 6, 7A-7I one of said piston-cylinder actuators is indicated with 121, while a second identical and parallel actuator is disposed at the opposite end of the head, at the level of the other of the two crosspieces 5 (see FIGS. 10, 11). Hereinafter the term actuator 121 is intended as the entire control member constituted by the pair of piston-cylinder actuators in parallel with each other.

The actuator 121 controls the oscillating movement of one or of the other of the two moving units. As will be explained hereunder, as the oscillating movement must be imparted alternately to one or to the other of the two half-heads, the two moving units 113A, 113B are both equipped with a respective stop 123A, 123B, cooperating with a bar 124 integral with the crosspiece 5 (FIG. 6). The bar 124 forms a continuous abutment along the extension of the crosspiece, interrupted only in two points, in which oscillation of one or of the other of the two moving units 113A, 113B must be allowed. In the activation position of the half-head 107A the bar 124 has an interruption at the level of the stop 123A (indicated with 124B in FIG. 5), while it is integral at the level of the stop 123B, so that an extension of the piston-cylinder actuator 121 causes a downward oscillation of the unit 113A, while the unit 113B remains still. The opposite occurs in the position in which the moving unit 113B must be actuated.

A second control member, constituted by a pair of piston-cylinder actuators 122 in parallel, is connected to the two arms 114A, 114B formed by the sides 115A and by the crosspieces 117A respectively or by the sides 115B and by the crosspieces 117B respectively, hinged and oscillating about the axes AA-AA, AB-AB. Hereunder the term actuator 122 is intended as the control device inclusive of the two piston-cylinder actuators 122 in parallel with each other.

Figure 5:
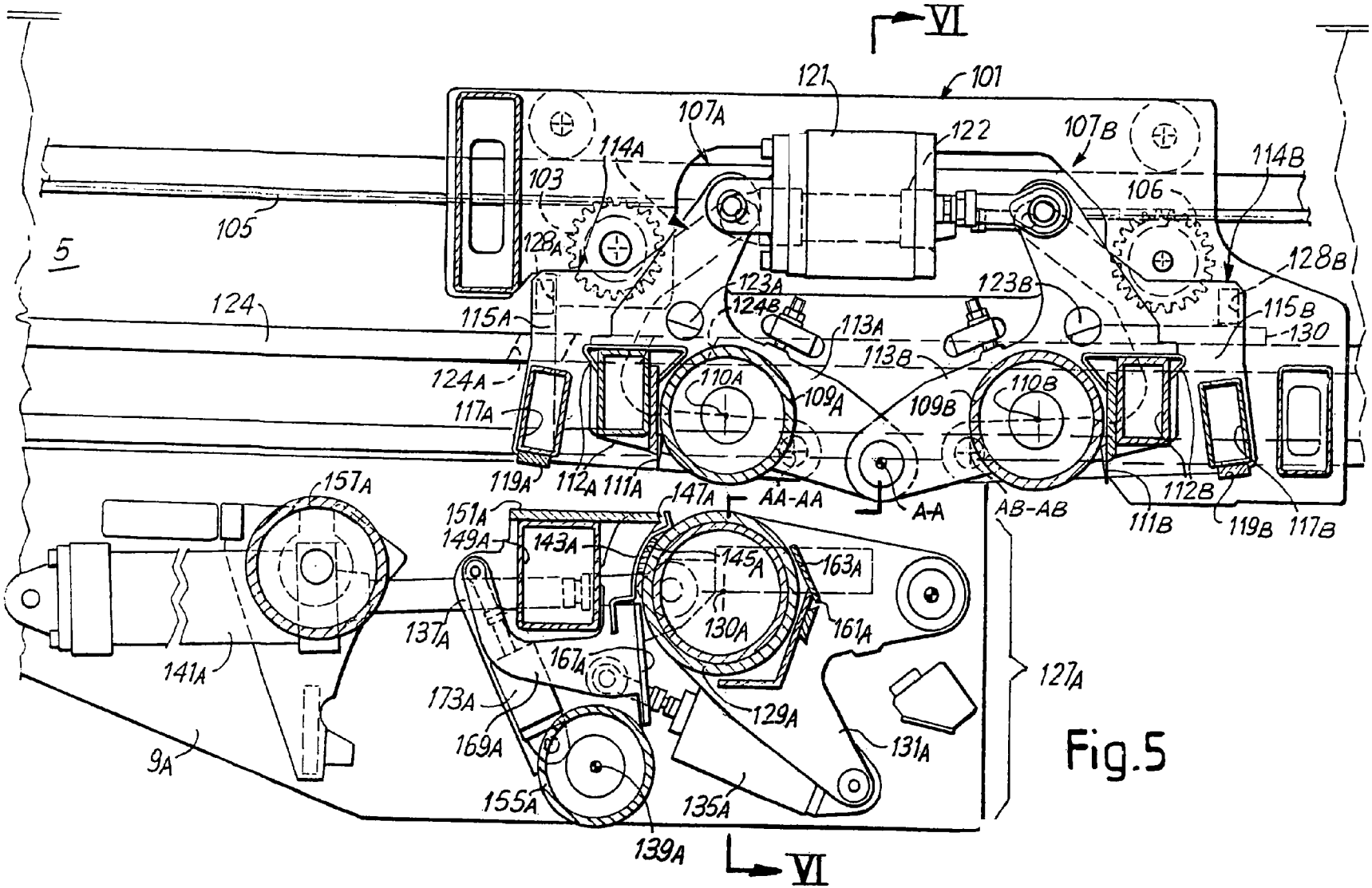
FIG. 5 shows an enlargement of the two upper half-heads of the splicing device, in juxtaposition with one of the two lower half-heads.
Figure 6:
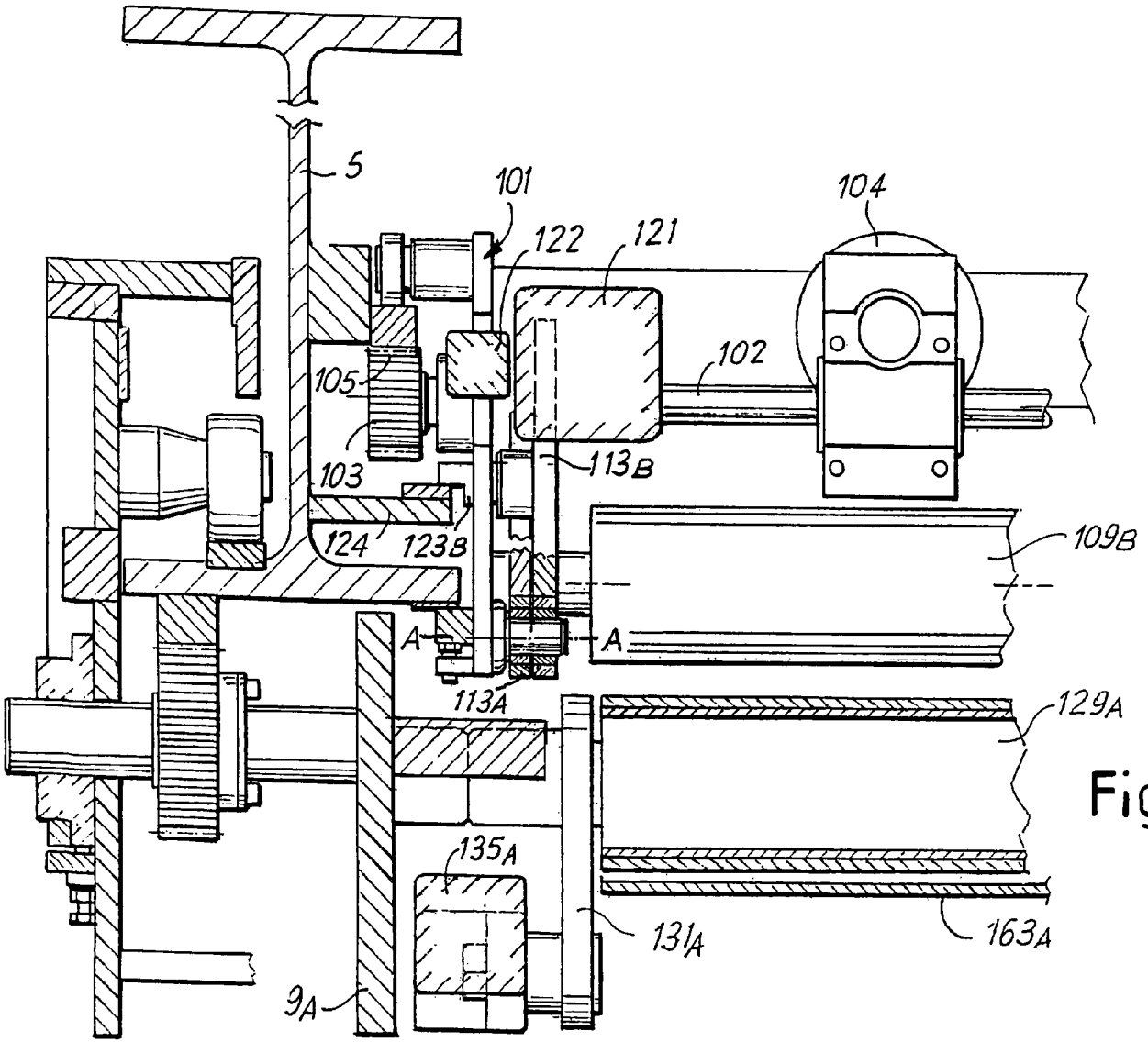
FIG. 6 shows a schematic section according to VI-VI in FIG. 5.

The actuator 122 causes oscillation selectively of one or of the other of the two arms 114A, 114B, thanks to the presence of stops 128A, 128B, cooperating with profiles fixed with respect to the crosspiece 5, one of which is shown at 130 in FIG. 5. A respective fixed profile 130 is provided in each of the two operating positions of the carriage 101, to selectively block one or the other of the two arms 114A, 114B. FIG. 5 shows the profile 130 to block the arm 114B, while the arm 114A is free to oscillate downwards and for this purpose the bar 124 has a break 124A.

The two half-heads 107A, 107B cooperate with corresponding half-heads 127A, 127B, each carried by one of the two slides 9A, 9B. The two lower half-heads 127A, 127B are essentially symmetrical and their components are indicated with the same reference numbers, followed by the letter A and by the letter B respectively. Hereunder the lower half-head 127A will be described in detail with reference to FIGS. 5, 7A-7I.

It has a roller 129A advantageously coated in rubber and supported idle on an axis 130A carried by a pair of oscillating arms 131A forming a first support oscillating about an axis of oscillation 133A. Oscillation of the pair of arms 131A is controlled by a piston-cylinder actuator 135A connected with its rod to an extension of the arm 131A and with the cylinder to the slide 9A. The piston-cylinder 135A may be double, just as the cylinders 121 and 122.

Moreover, a second oscillating support, formed by a pair of oscillating arms 137A hinged about an axis of oscillation 139A, is connected to the slide 9A. Oscillation is controlled by a piston-cylinder actuator 141A, if necessary double. The second oscillating support 137A carries a clamping bar 143A provided with a strip of elastic material 145A, said bar cooperating with the roller 129A for the objects to be explained hereunder.

A counter-blade 147A, cooperating with the blade forming the cutting member 111A, is integral with the clamping bar 143A. A counter-pressure surface 151A, with which braking means 117A, 119A cooperate, is integral with a crosspiece 149A supporting the bar 143A. Further elements belonging to the lower half-heads 127A, 127B shall be described hereunder with reference to the operations to prepare the initial edge of the web material of each reel.

The detail of the working operations of the members of the splicing device shall be described later on. For the moment it is sufficient to observe, with reference to FIGS. 1 to 4, that to perform splicing of the web material NA being unwound from the reel BA to the material NB standing by on the reel BB, the upper half-heads 107A, 107B carried by the carriage 101 are positioned approximately over the slide 9A integral with the arms 11A that support the reel BB, in a position whereby the lower half-head 127A, which must cooperate with the upper half-head 107A is positioned thereunder. The web material NA being supplied by the reel BA that is in the central position is driven around the roller forming the counter-pressure member 109B of the upper half-head 107B, which does not participate in the splicing operations during replacement of the reel BA with the reel BB.

Figure 2:
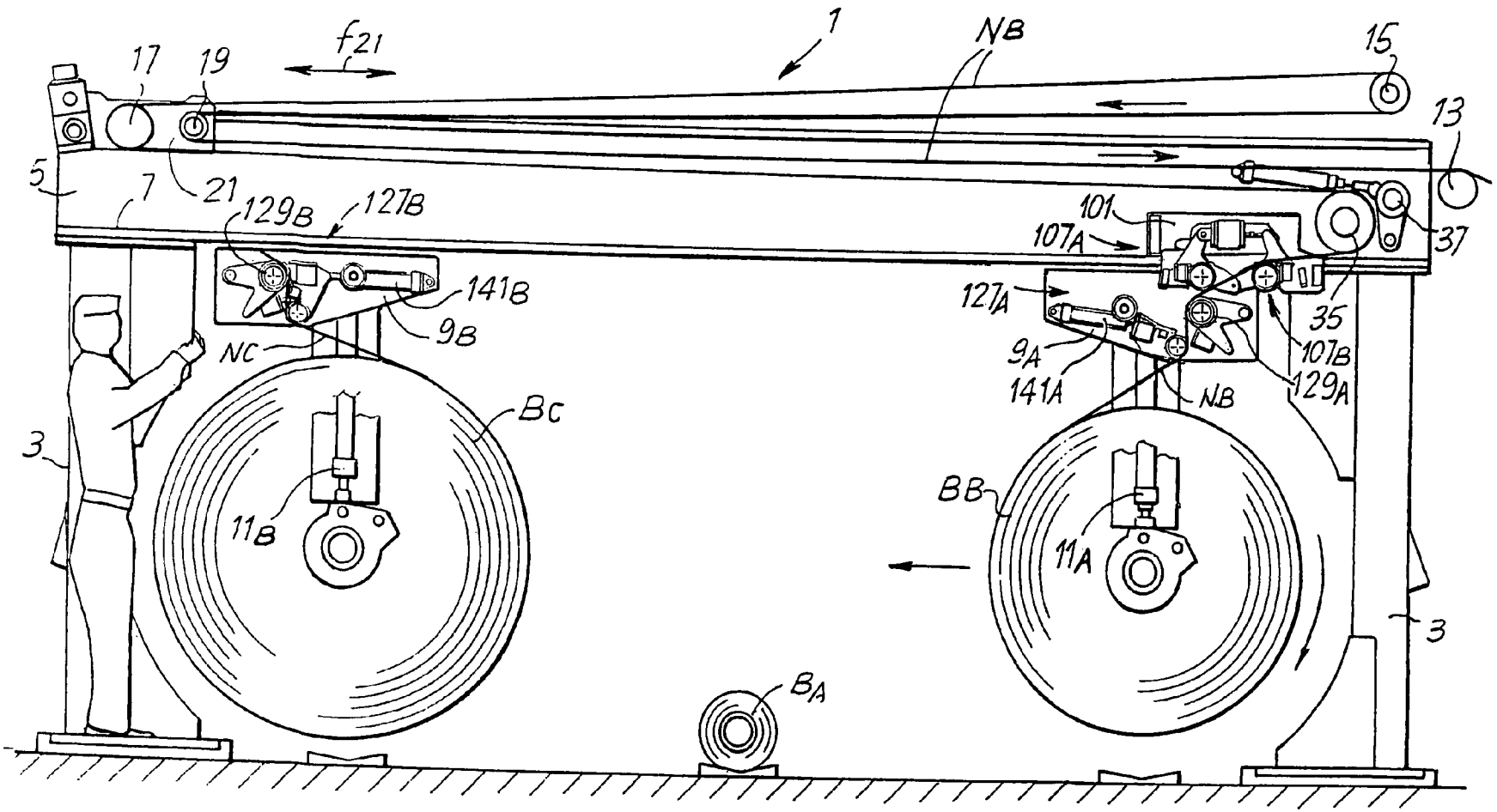

Splicing of the web materials NA and NB takes place by temporarily stopping supply of the material NA from the reel BA, having previously fully filled the storage formed by the festoon positioned above the crosspiece 5. With the material NA and NB stopped, the materials are spliced in the shortest possible time and subsequently the reel BB is accelerated and taken to operating speed. The reel BA, which may have come to an end or may be replaced simply to change the material being processed when there is a change in order, is placed on transferring means, known and not shown, to be removed, while the lifting and lowering means 11B are transferred, carried by the slide 9B, towards the third reel BC standing by. When they reach it, the reel BC is engaged and lifted and the free edge of the web material NC wound thereon is pre-positioned on the lower half-head 127B of the splicing device (FIG. 2).

Figure 3:
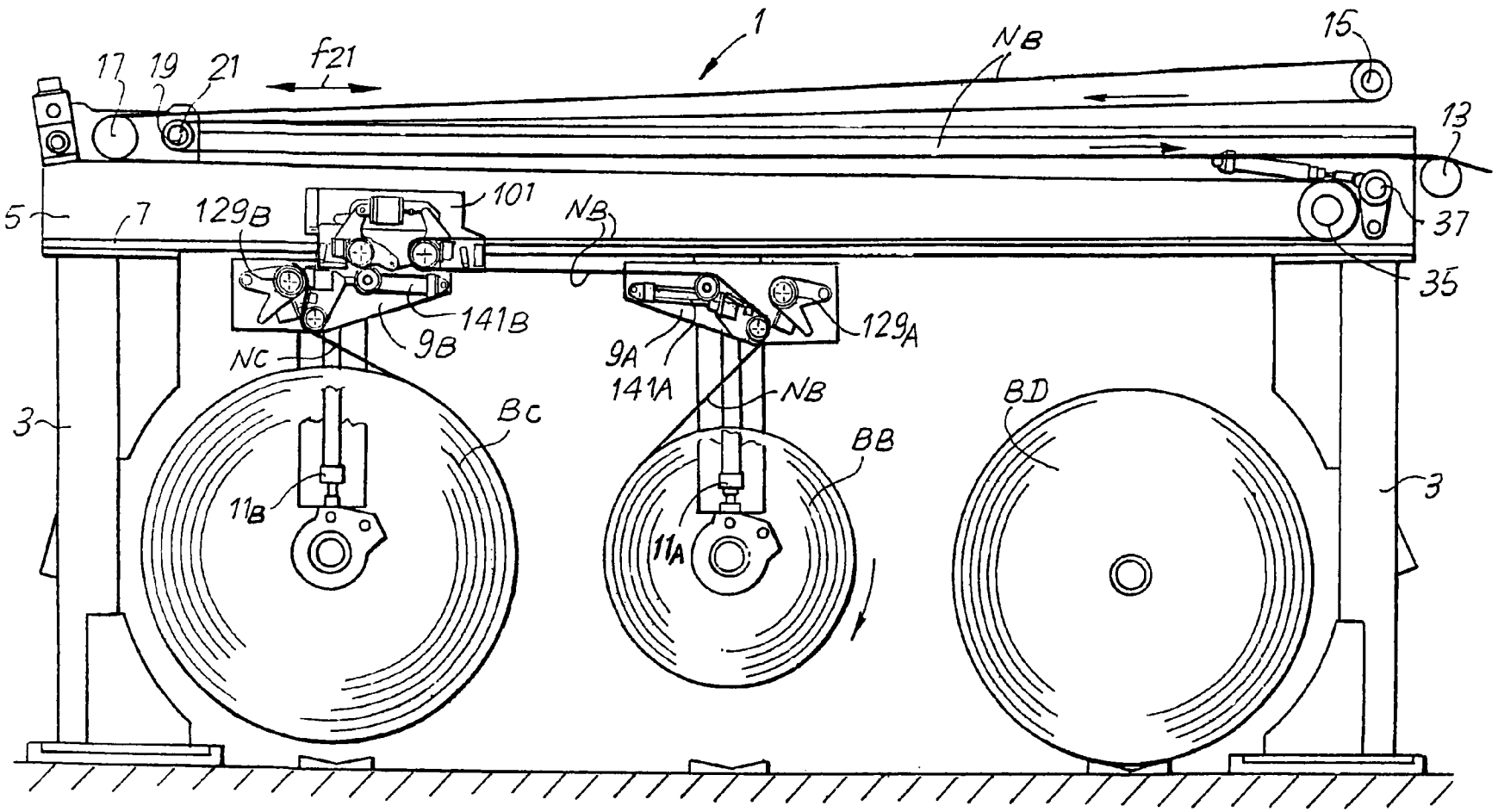

In the meantime the reel BB is carried to the intermediate position by the slide 9A with the lifting means 11A and a reel BD is inserted in the position originally occupied by the reel BB (FIG. 3).

The carriage 101 carrying the two upper half-heads 107A, 107B translates towards the left position, in the drawing, to position itself with the upper half-head 107B at the level of the lower half-head 127B carried by the slide 9B so as to pre-position itself for splicing the web material NB supplied by the reel BB to the leading edge of the web material NC of the reel BC waiting for the next replacement cycle. The position of the carriage 101 pre-positioned to perform this operation is shown in FIG. 3.

The slides 9A, 9B have rollers 155A, 155B disposed so as to define a feed path of the web material that allows the aforesaid movements both of the carriage 101 and the slides 9A, 9B, as can be easily understood by the sequence in FIGS. 1-4.

When the reel BB must be replaced with the reel BC, the upper 107B and lower 127B half-heads in the position in FIG. 3 perform splicing, after rotation of the reel BB has been temporarily stopped. Subsequently, (FIG. 4) the reel BB is placed on the transfer means and removed, the slide 9A is transferred towards the reel BD to engage it by the means 11A, the reel BC is translated to the central position by the slide 9B and the means 11B, the carriage 101 can be transferred towards the position shown in FIG. 1, to be pre-positioned for the subsequent splicing operation of the web material ND wound on the reel BD to the web material NC supplied by the reel BC.

The splicing cycle performed by the splicing device shall now be described in detail with reference to operation of the half-heads 107A, 127A (for example to splice the web materials NA, NB when replacing the reel BA with the reel BB, FIGS. 1, 2), it being understood that the cycle performed by the half-heads 107B, 127B is specular.

Figure 7A:
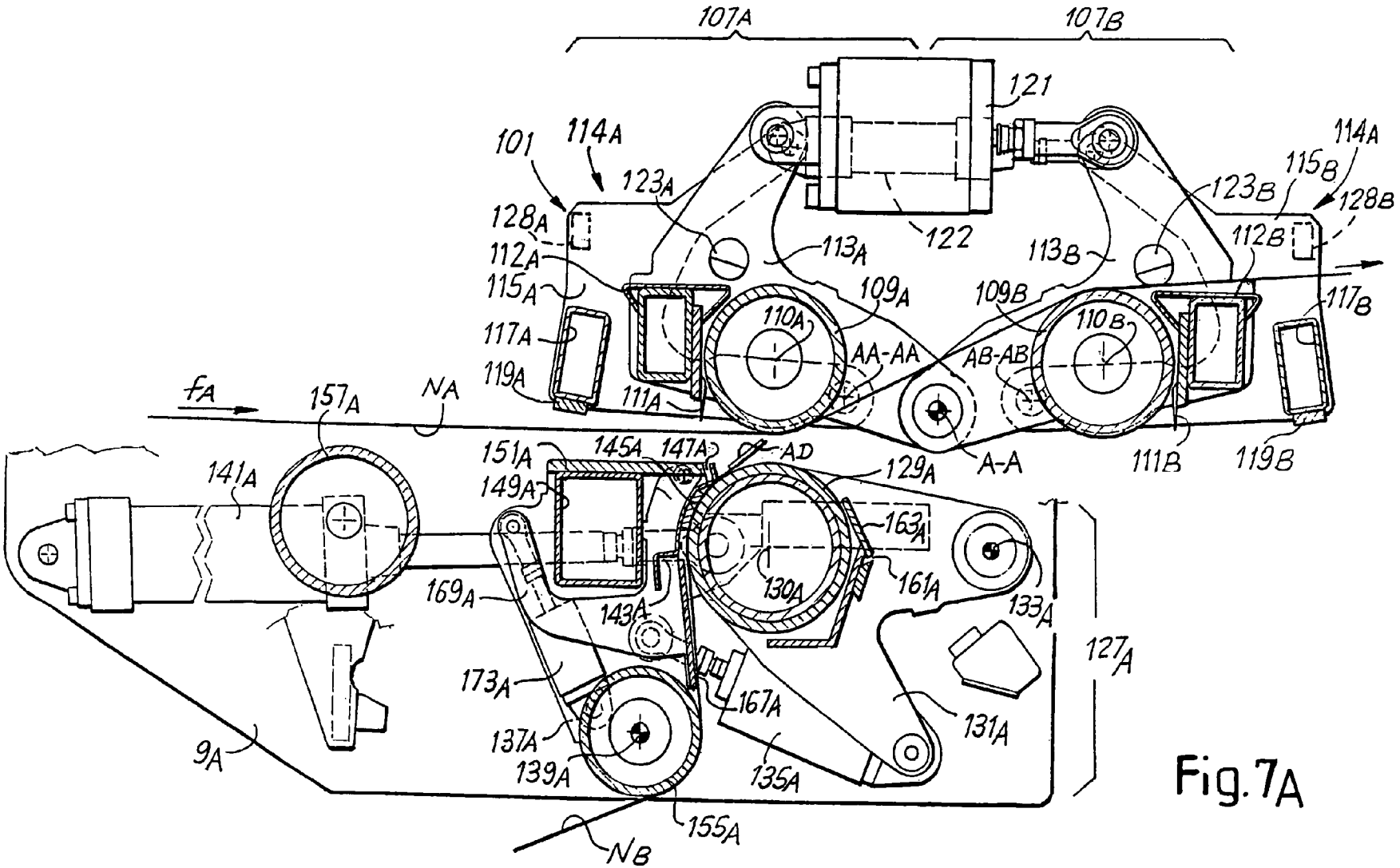
FIGS. 7A-7I shows a splicing operating sequence with reference to one of the two heads of the splicing device.

With initial reference to FIG. 7A, the web material NA is fed according to the arrow fA and is driven around a roller 109A forming the counter-pressure member of the upper half-head 107A, and around the roller 109B forming the counter-pressure member of the upper half-head 107B.

The initial or leading edge of the web material NB of the reel BB was previously trimmed and provided with a strip of double-sided adhesive AD and is clamped between the roller 129A and the strip of rubber or other resilient material 145A of the clamping bar 143A. The piston-cylinder actuator 135A in this phase acts like a pneumatic spring that holds the roller 129A against the clamping bar 143A and its strip of rubber 145A.

Figure 7B:
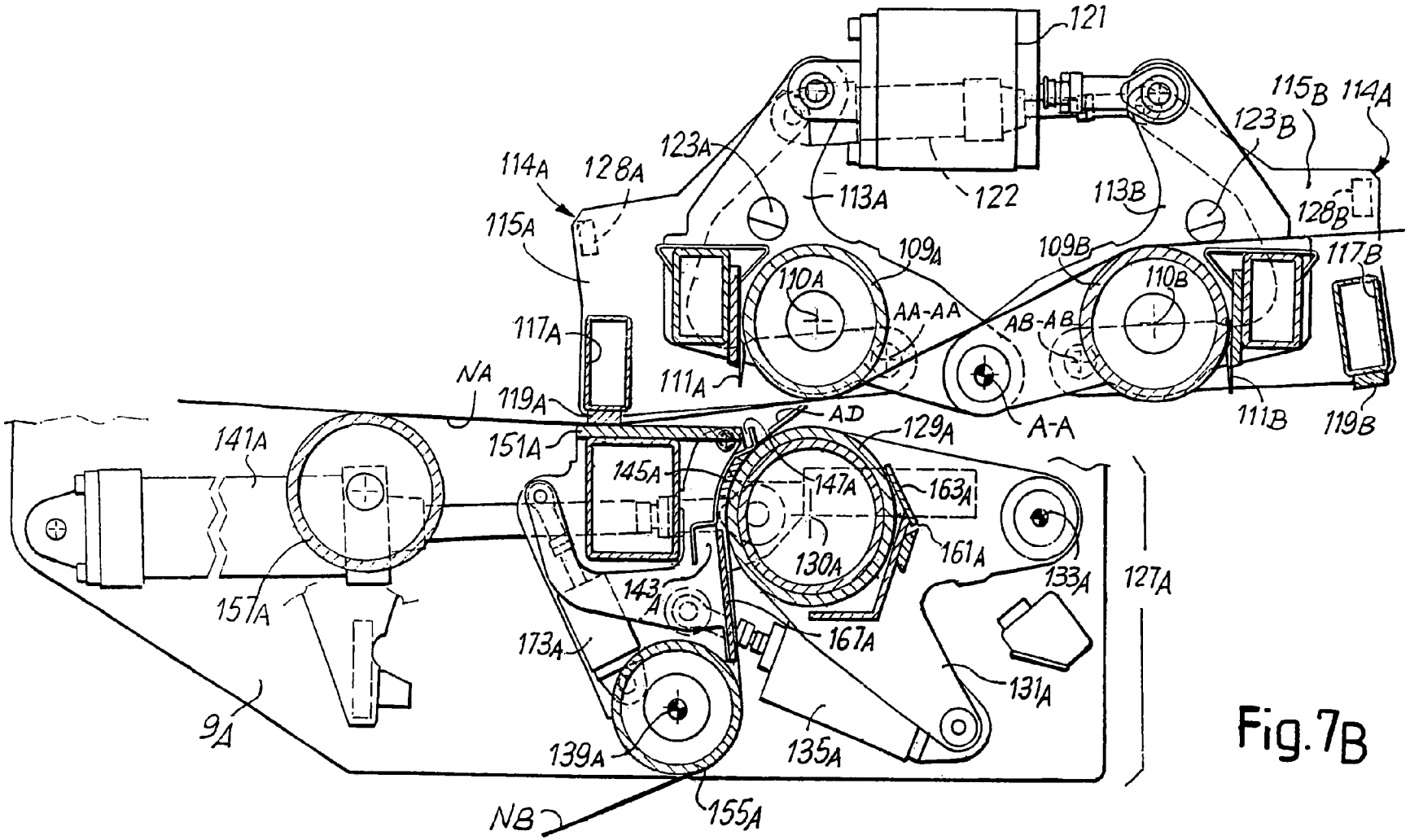

When splicing of the leading edge of the web material NB and the final part of the web material NA is to be performed, the control member, constituted by the pair of actuators 122 in parallel, is activated. In the position in which the carriage 101 carrying the upper half-heads 107A, 107B is located, the bar 124 has a break 124A at the level of the stop 128A, while the stop 128B is positioned at the level of the profile 130. Therefore, extension of the actuator 122 causes downward oscillation of the arm 114A and of the pad 119A of the half-head 107A, while the same members of the half-head 107B remain clamped by the effect of the stop 128B which cooperates with the profile 130. In this way the position in FIG. 7B is reached. Rotation of the reel BA is stopped in advance or simultaneously, while the web material is supplied to the station downstream by means of the supply that has accumulated in the festoon formed above the crosspiece 5.

Subsequently (or simultaneously) the control member, composed of the pair of piston-cylinder actuators 121 in parallel, is activated. Thanks to the presence of the break 124B (FIG. 5) in the bar 124 at the level of the stop 123A and of the continuity of the bar at the level of the stop 123B, this causes lowering of the moving unit formed by the sides 113A with the counter-pressure member 109A and the cutting member 111A carried by said sides.

Figure 7C:
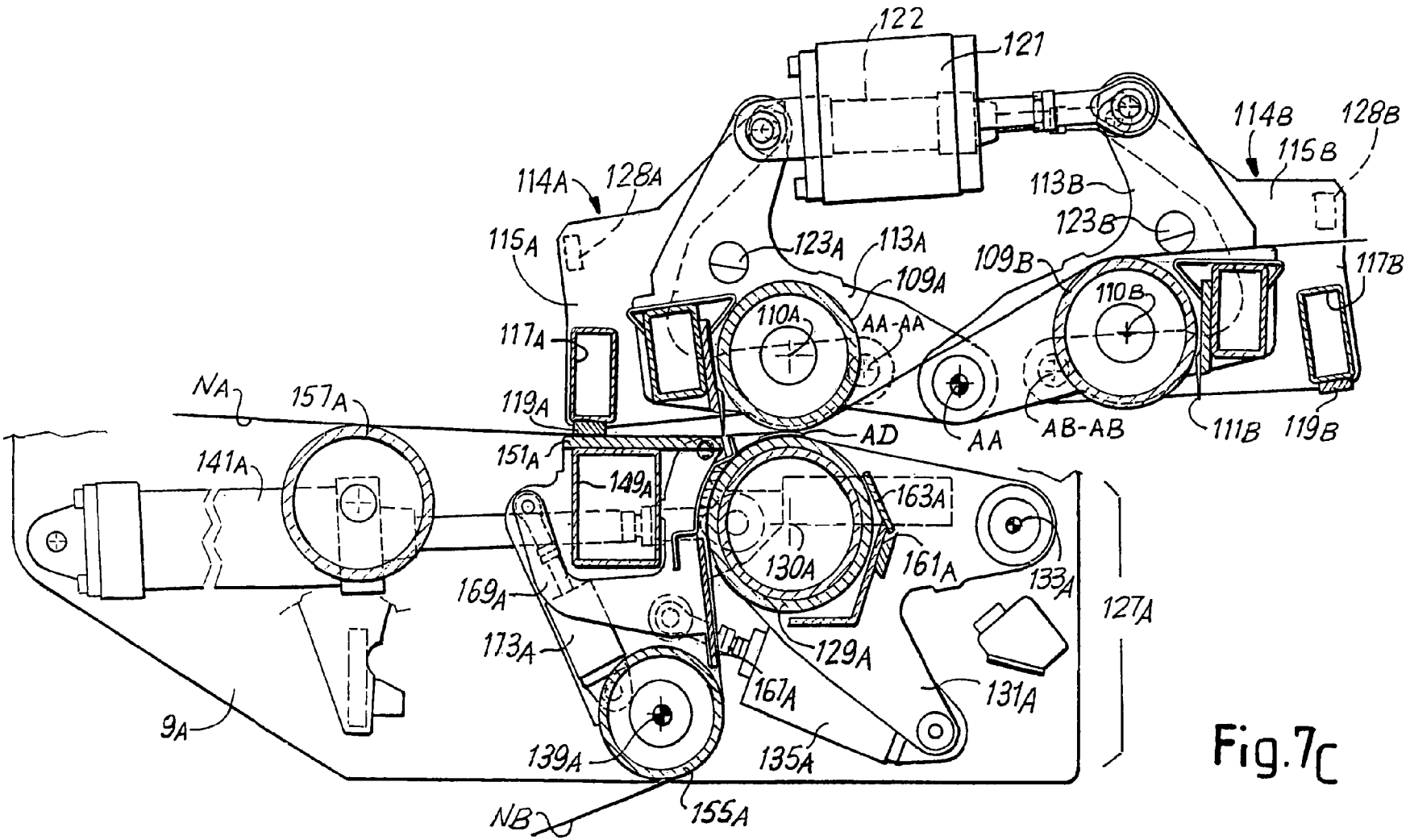

FIG. 7C shows the final position reached by the braking means 119A against the counter-pressure surface 151A and an intermediate lowering position of the moving unit carrying the counter-pressure member 109A and the cutting member 111A. In the position shown in FIG. 7C, the cutting member partially penetrates the web material NA, while the counter-pressure member 109A is already pressed against the underlying roller 129A, so that the web material NA is pressed against the leading edge of the web material NB provided with double-sided adhesive AD.

The pressure between the roller forming the counter-pressure member 109A and the underlying roller 129A of the lower half-head 127A causes reciprocal adhesion of the web materials NA, NB by the double-sided adhesive AD. By continuing the downward thrust produced by the counter-pressure member 109A under the control of the actuator 121 (and against the effect of the pneumatic actuator 135A which in this phase acts as a pneumatic spring) the roller 129A is made to detach from the clamping bar 143A, 145A, (FIG. 7D) so that the web material NB is released and can be drawn by the tail of the material NA which is simultaneously cut upstream of the splicing area by the blade 111A. The pull exerted on the web material NA by the roller 35 and acceleration of the reel BB by motor members associated with the supporting members 11B make the web material NB move and it starts to be supplied. Start of rotation of the reel BB from which the web NB is supplied and acceleration of the roller 35 can be controlled by a signal produced by a sensor (not shown) which detects the movements of the members of the splicing device head. In a preferred embodiment, nonetheless, the web material NB is accelerated automatically with a procedure of the following type. The accelerator roller 35 may be controlled so that a driving torque is always applied to it, even during the splicing phase. When the web material NA is braked by the members 117A; 119A, 151A, the roller 35 is braked and stopped, but the torque applied to it holds the web material in tension. As soon as the material NA has been cut the pulling force exerted by the material blocked by the brake 119A is removed and the torque applied to the roller 35 causes initial acceleration of the web material NA and therefore rotation of the rollers 109A and 129A. This causes adhesion of the leading edge of the web material NB and feed of this new material towards the roller 35 to commence. This movement is detected by the encoder associated with the accelerator roller 35 and is interpreted as enabling of the angular acceleration of the reel BB by the motor carried by the arms 11A.

By operating in this way it is understood that initial acceleration of the web material after splicing is not subordinate to the production of any signal, but occurs automatically as a consequence of cutting the material NA. Consequently, extremely rapid acceleration and immediate start of feed of the new reel BB are obtained.

Figure 7D:
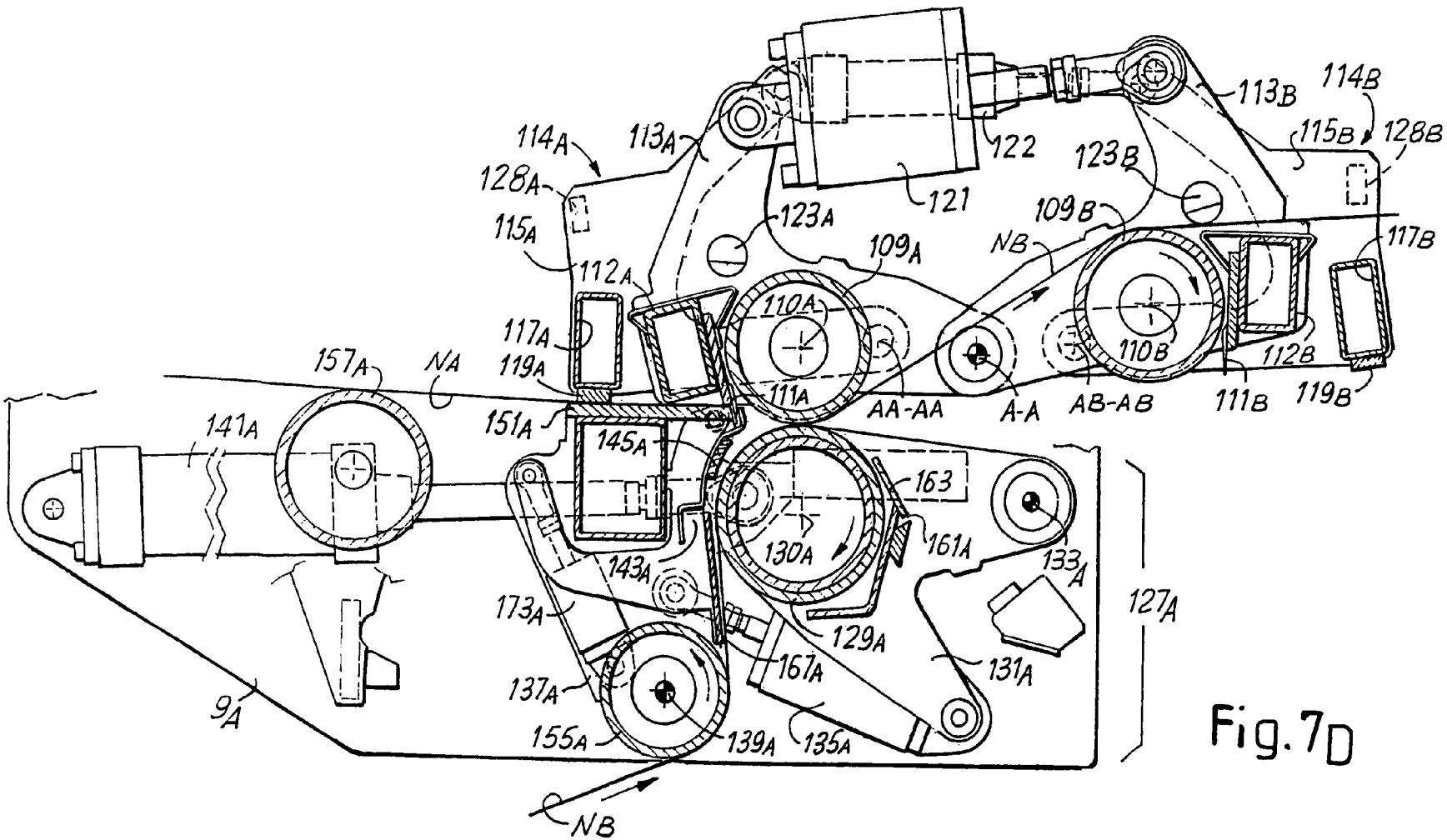
Figure 7E:
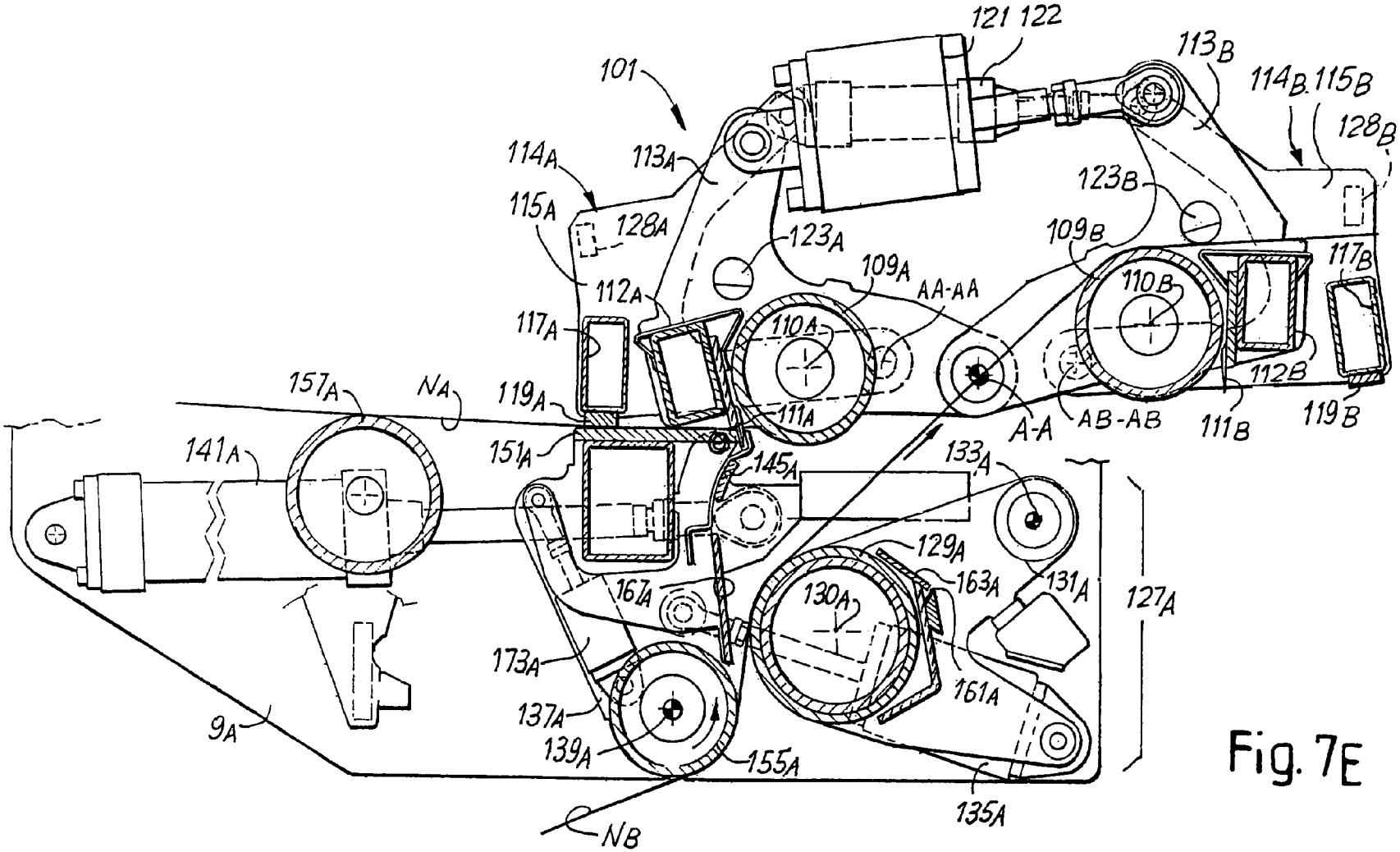

FIG. 7D shows a moment subsequent to splicing of the webs NA, NB, in which feed of the web NB has already commenced.

In actual fact the aforesaid operations are performed in a very short fraction of time and are almost simultaneous, thanks to the fact that a single actuator or control member 121 performs all the movements, with the exception of closing the braking means 117A, 119A, which may in any case be advanced with respect to the actual splicing phase. Therefore, this operation does not influence the splicing speed.

Figure 7F:
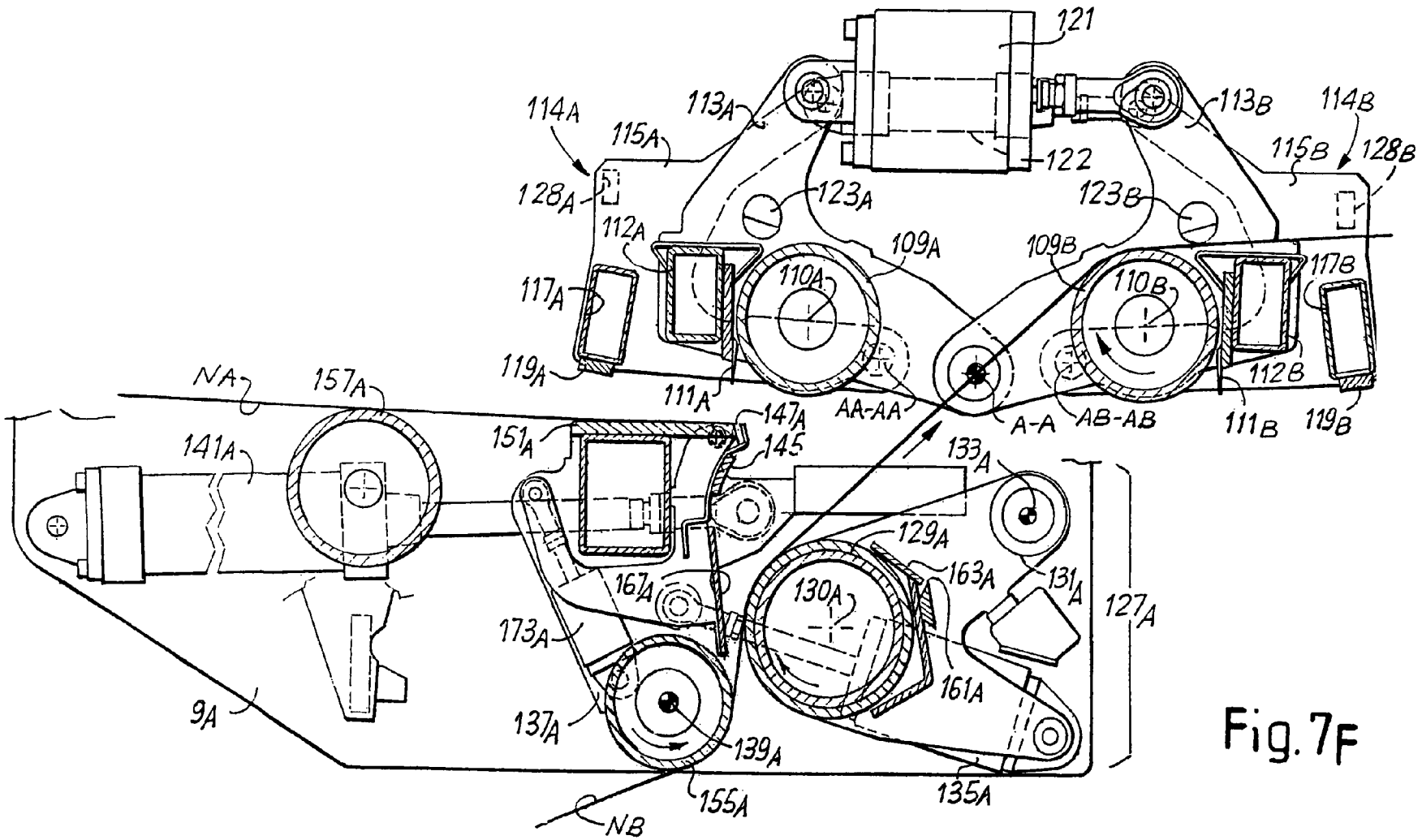
Figure 7G:
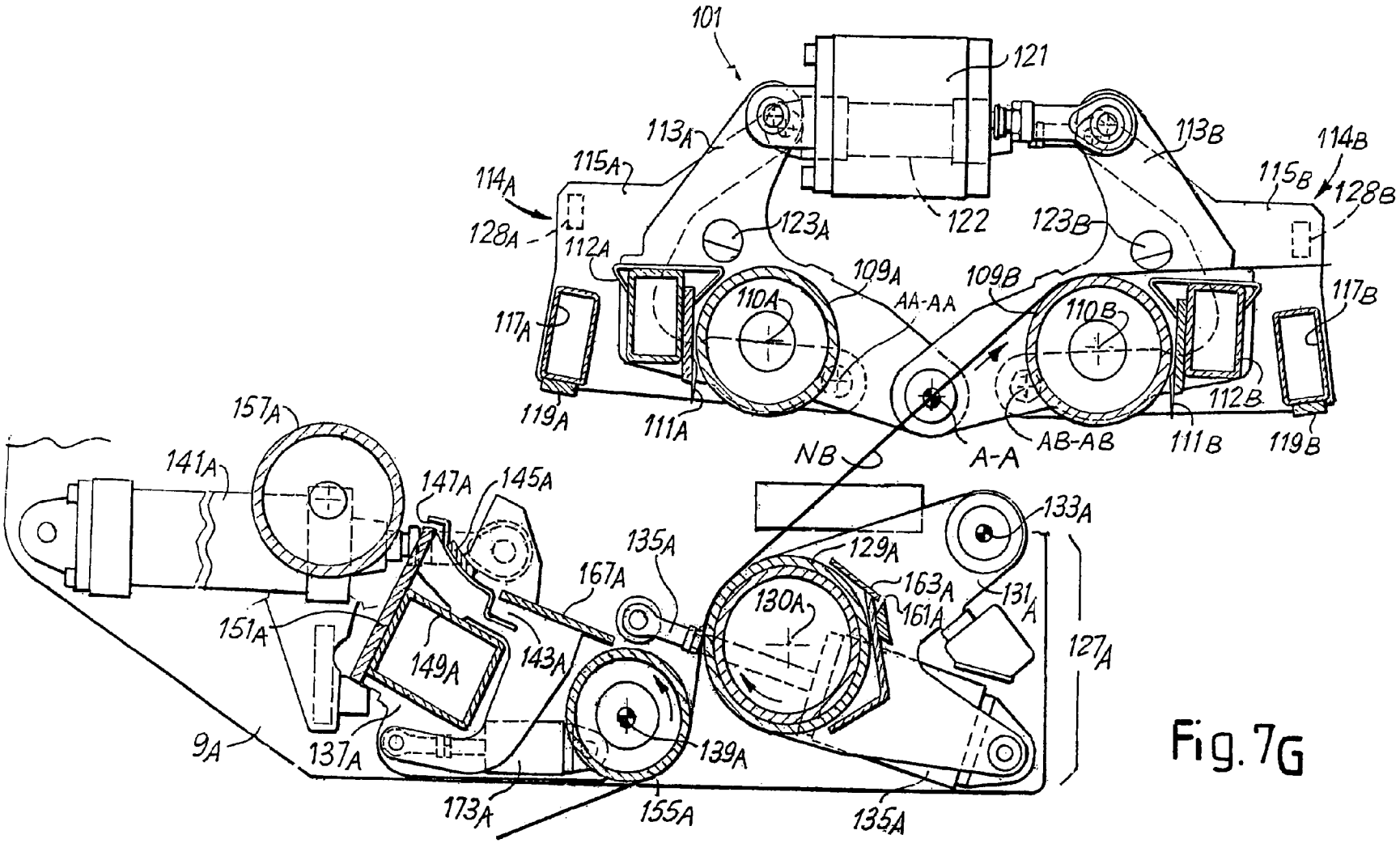

After splicing of the web materials NA, NB has taken place, the actuator 135A extends to cause further oscillation of the pair of arms 131A (FIG. 7E) to allow free feed of the web material NB. This is driven around a return roller 155A and around the counter-pressure member 109B of the second half-head 109A carried by the carriage 101. Simultaneously, or in the moment preceding or subsequent to lowering of the roller 129A by the actuator 135A, the actuator 141A and the actuators 121, 122 are operated. FIG. 7F shows the position reached with retraction of the actuators 121, 122 and consequent withdrawing of the braking member 117A, 117B from the counter-pressure surface 151A and of the roller forming the counter-pressure member 109A from the roller 129A. FIG. 7G shows the position adopted after retraction of the piston-cylinder actuator 141A, which causes withdrawing, by oscillation of the support 137A, of the clamping bar 143A from the roller 129A.

Figure 7H:
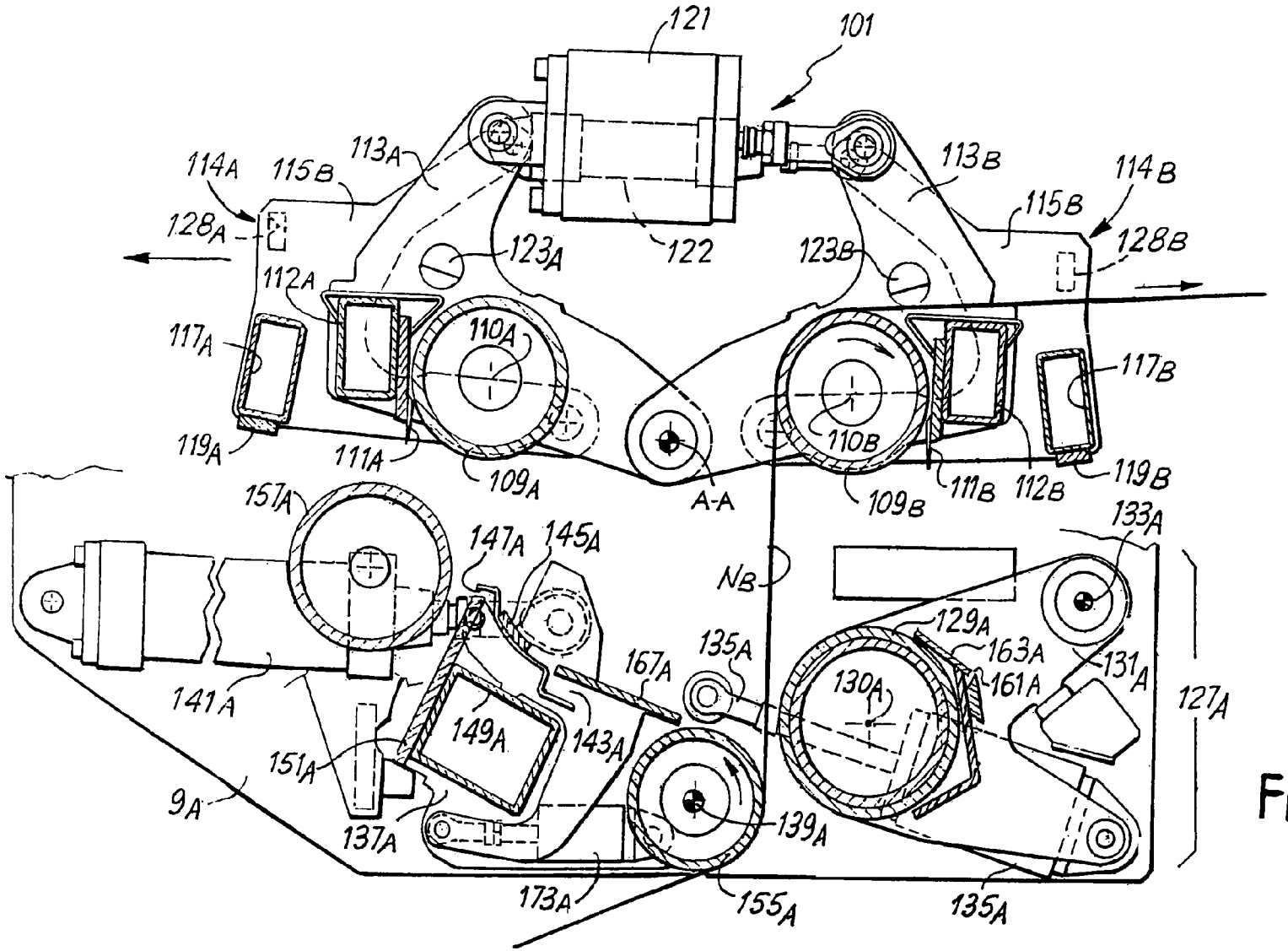
Figure 7I:
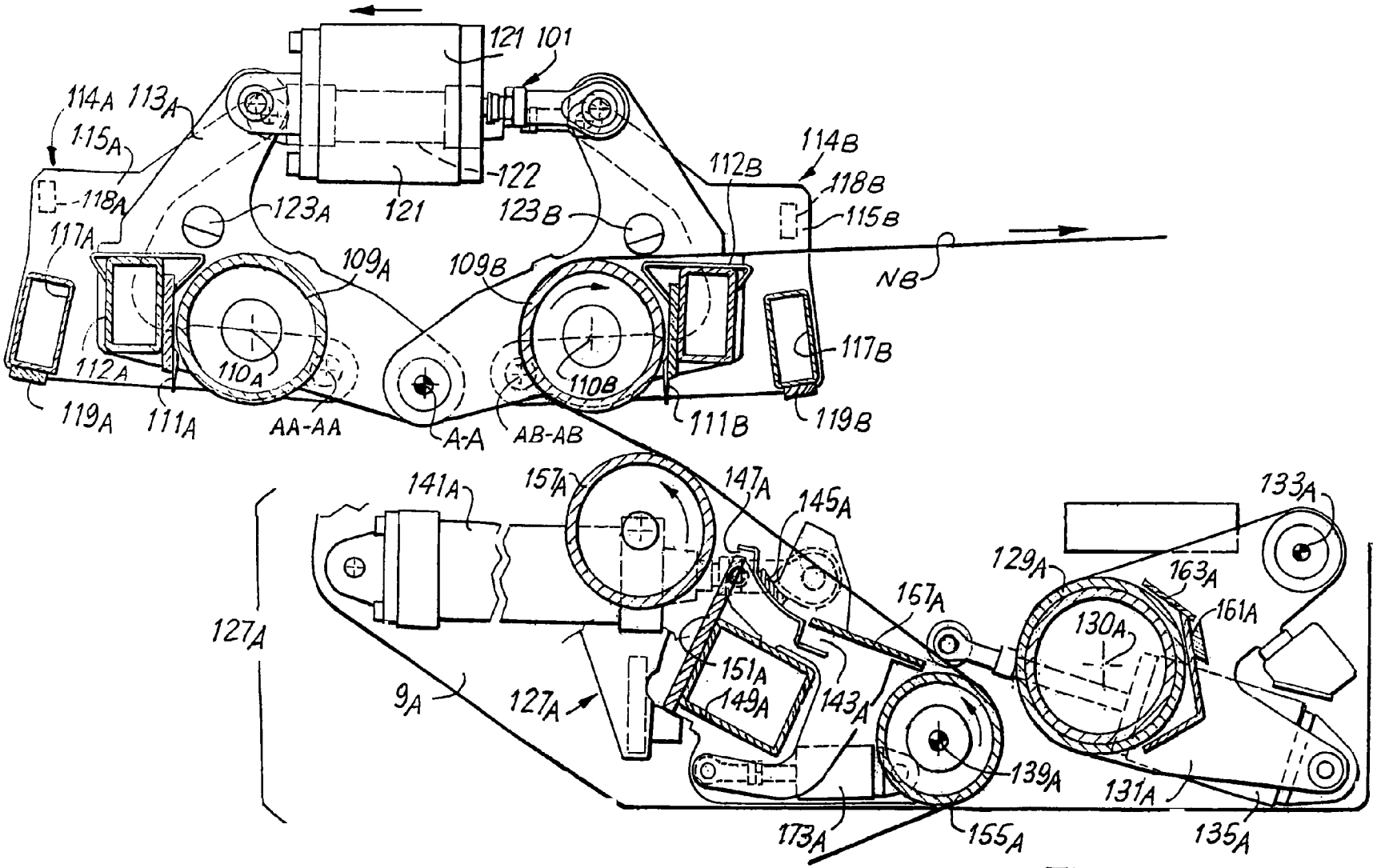

Once the position in FIG. 7G has been reached, the means 11B can release the reel BA and translate to the left (FIG. 2) to engage the reel BC, while the means 11A translate to the central position, left empty. The carriage 101 can also translate to the left carrying the half-head 107B to the position overlapping the lower half-head 127B carried by the slide 9B to pre-position itself to perform splicing of the web material NB being supplied by the reel BB with the head of the web material NC of the reel BC, which for this purpose is prepared in the way described hereunder. Translation of the carriage 101 from right to left to the position in FIG. 3 causes partial wrapping of the roller forming the counter-pressure member 109B by the web material NB. Disposed on the slide 9A is a guide roller 157A which acts as a guide for the web material NB when the carriage 101 moves beyond the intermediate position adopted by the means 11A. An analogous guide roller 157B is provided on the slide 9B. FIGS. 7H and 7I show start of movement of the carriage 101 with respect to the slide 9A and consequent modification of the path of the web material NB.

Figure 4:
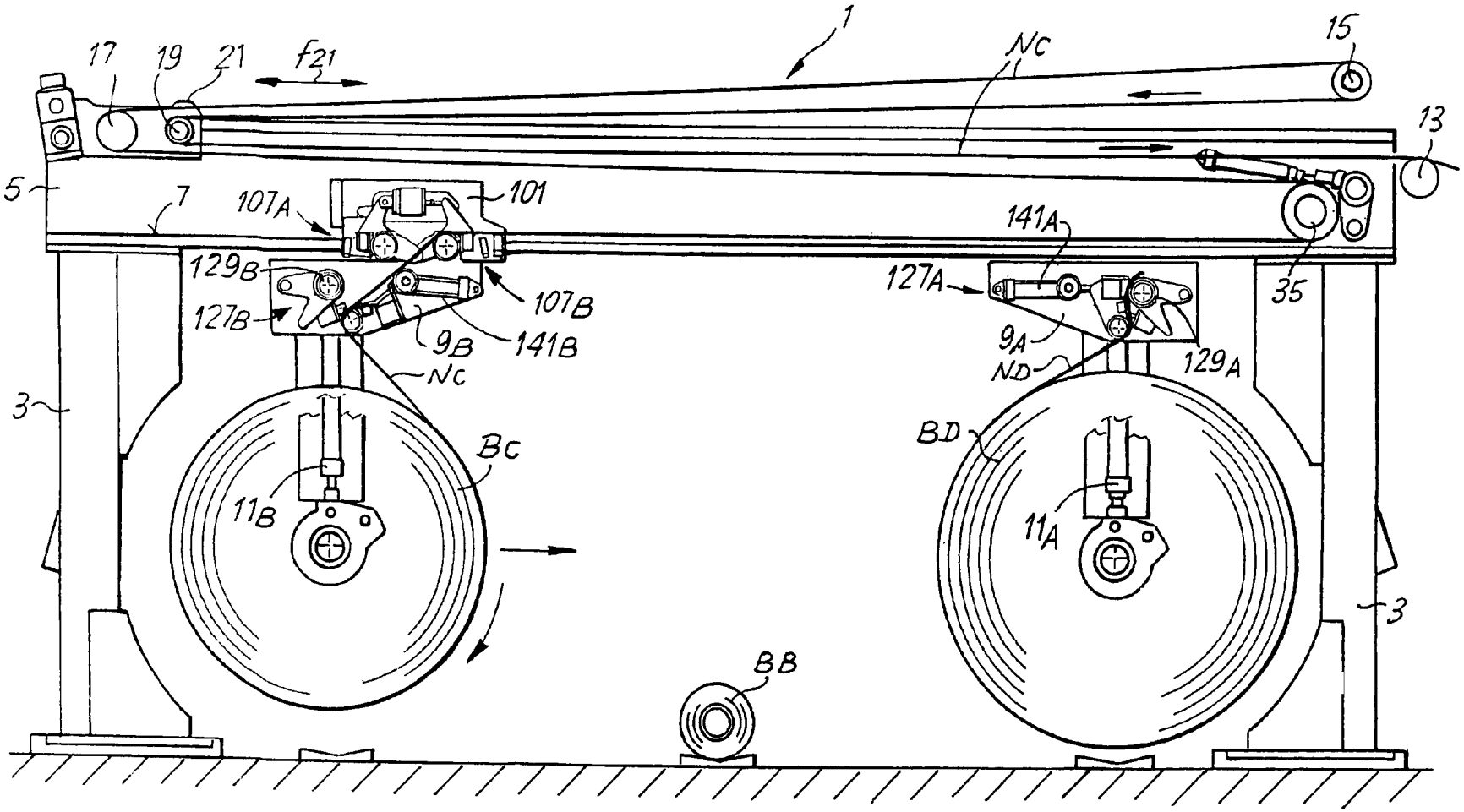
Figure 8A:
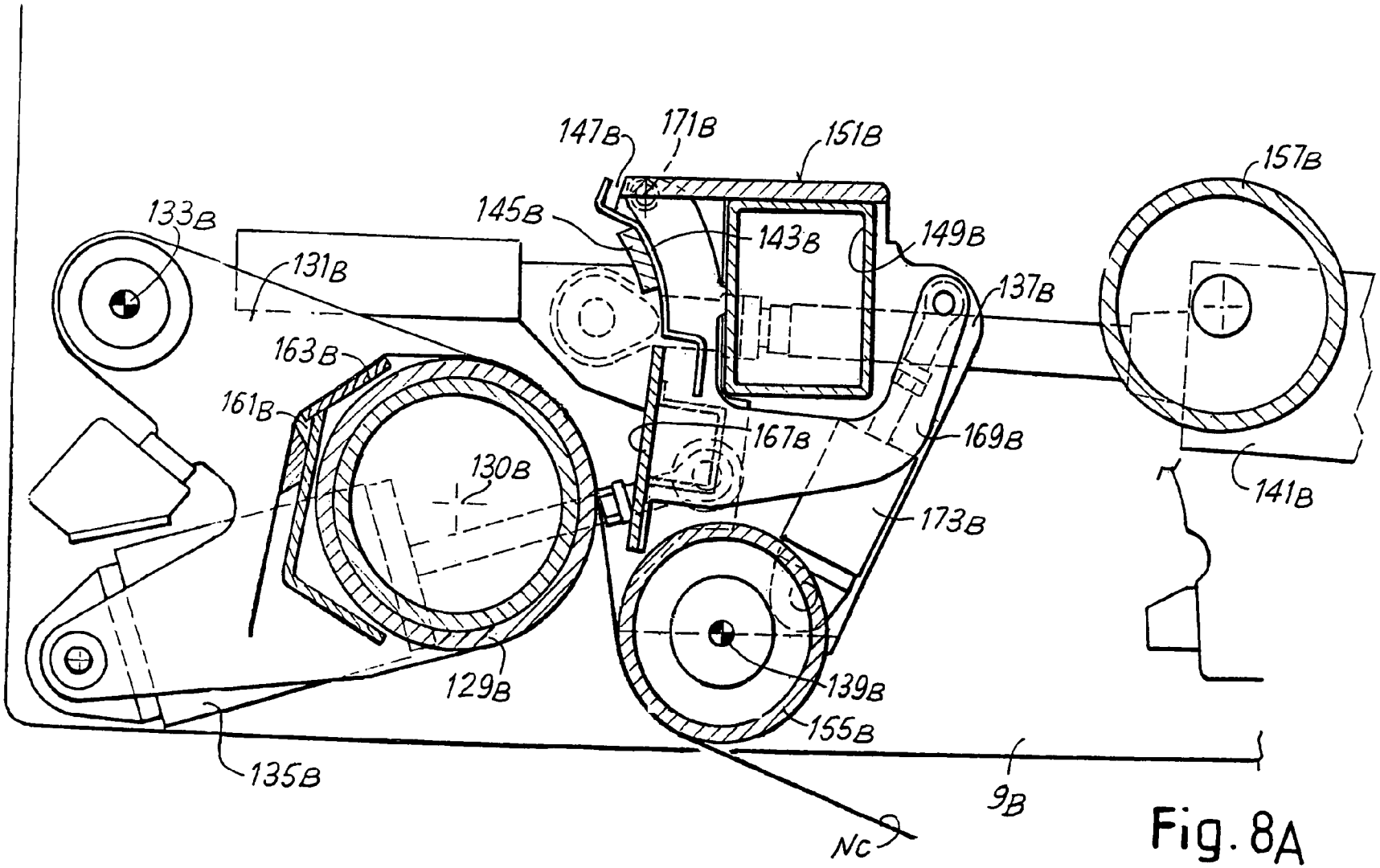
FIGS. 8A, 8B and 8C shows the sequences to prepare the initial edge of a reel with reference to the lower half-head of the other of the two heads of the splicing device.
Figure 8B:
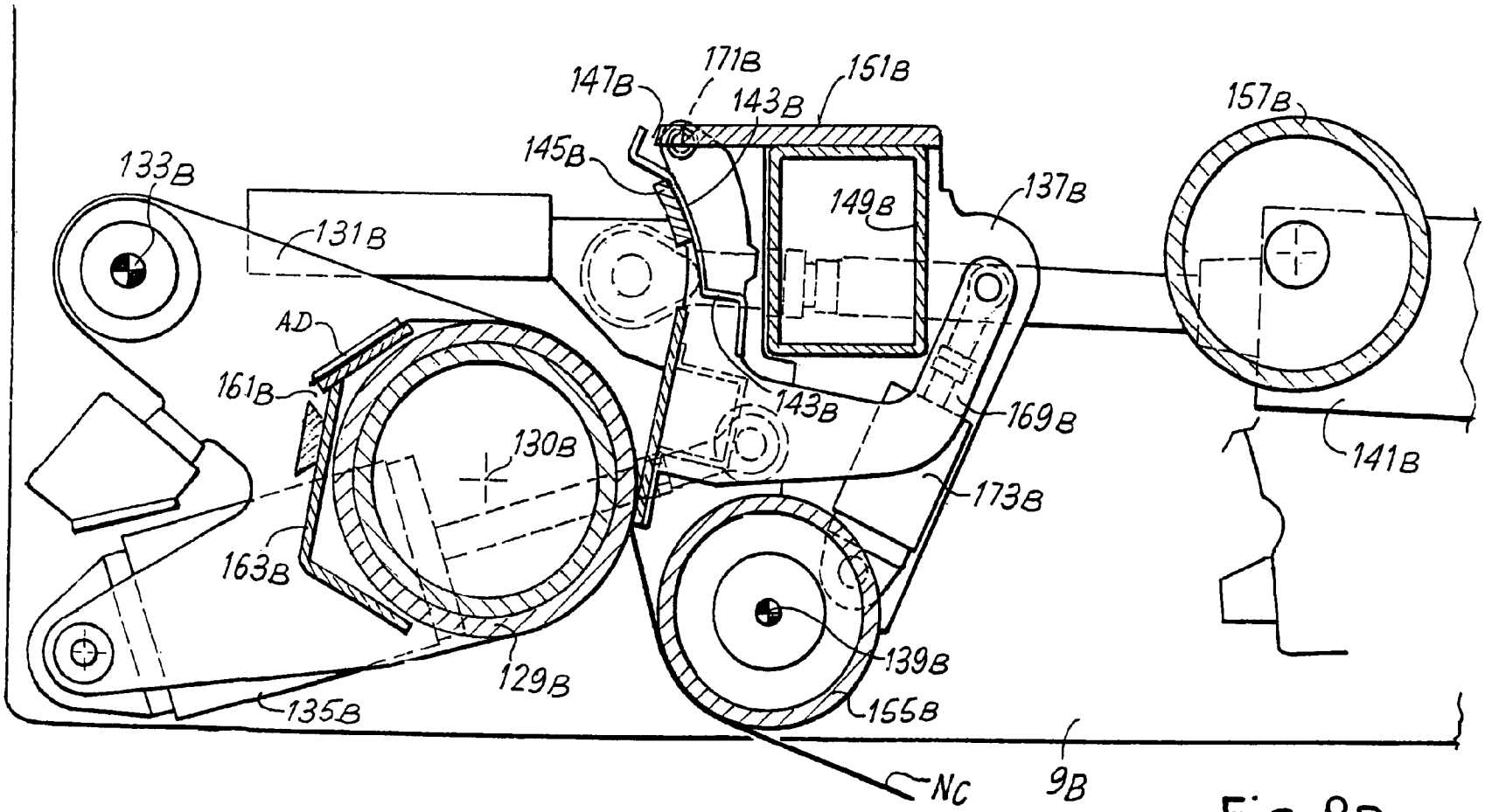
Figure 8C:
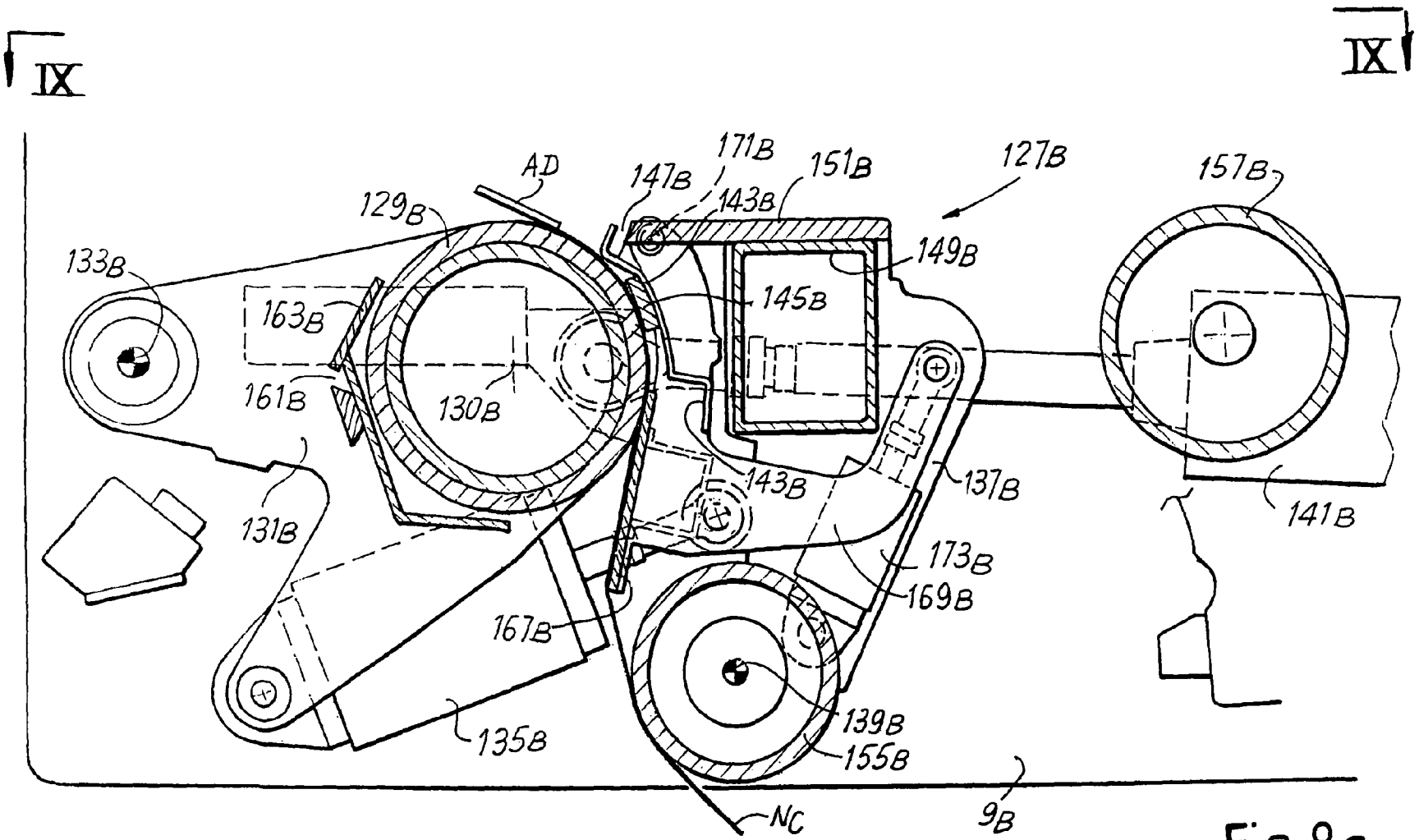
Figure 9:
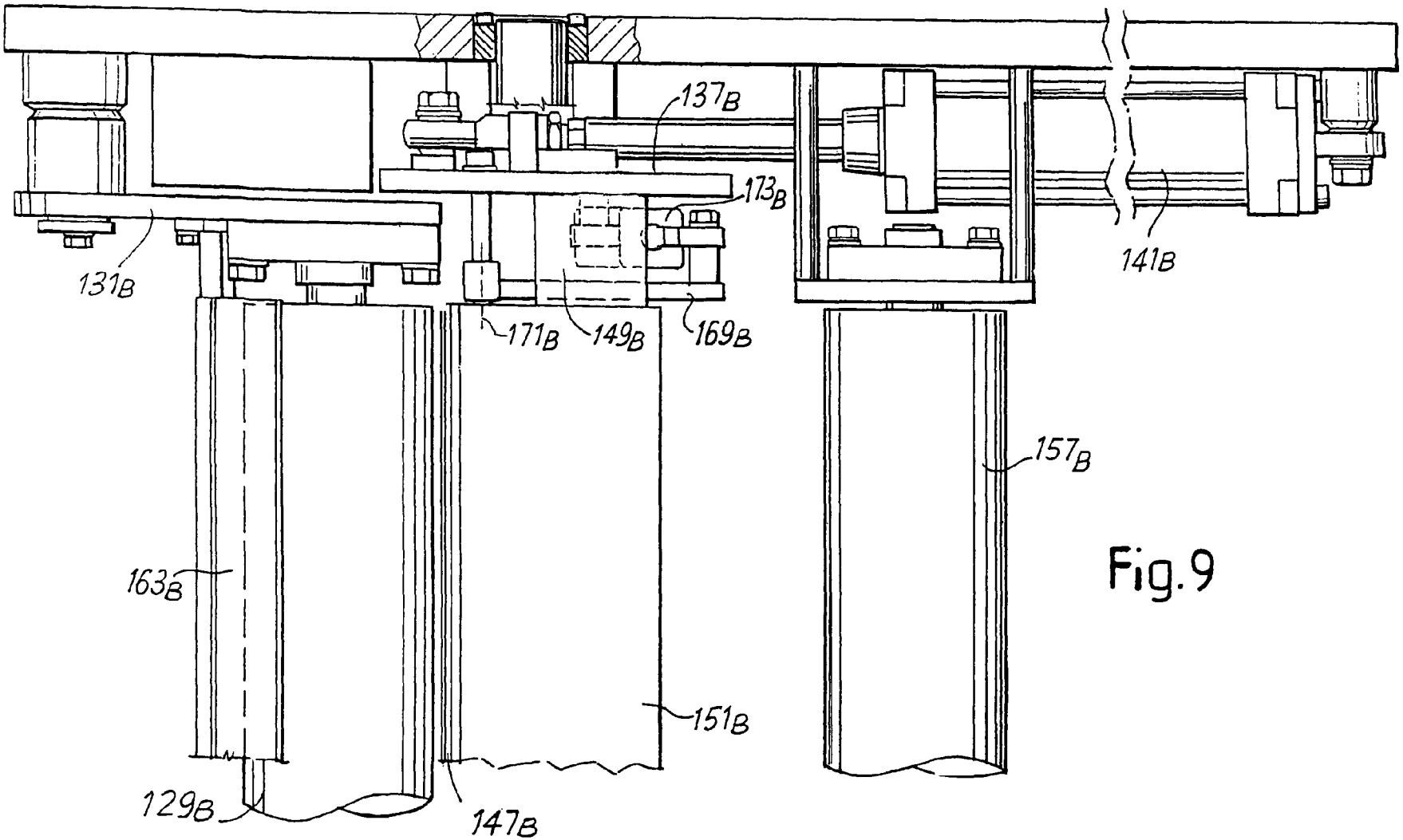
FIG. 9 shows a partial plan view according to IX-IX in FIG. 8C.
Figure 10:
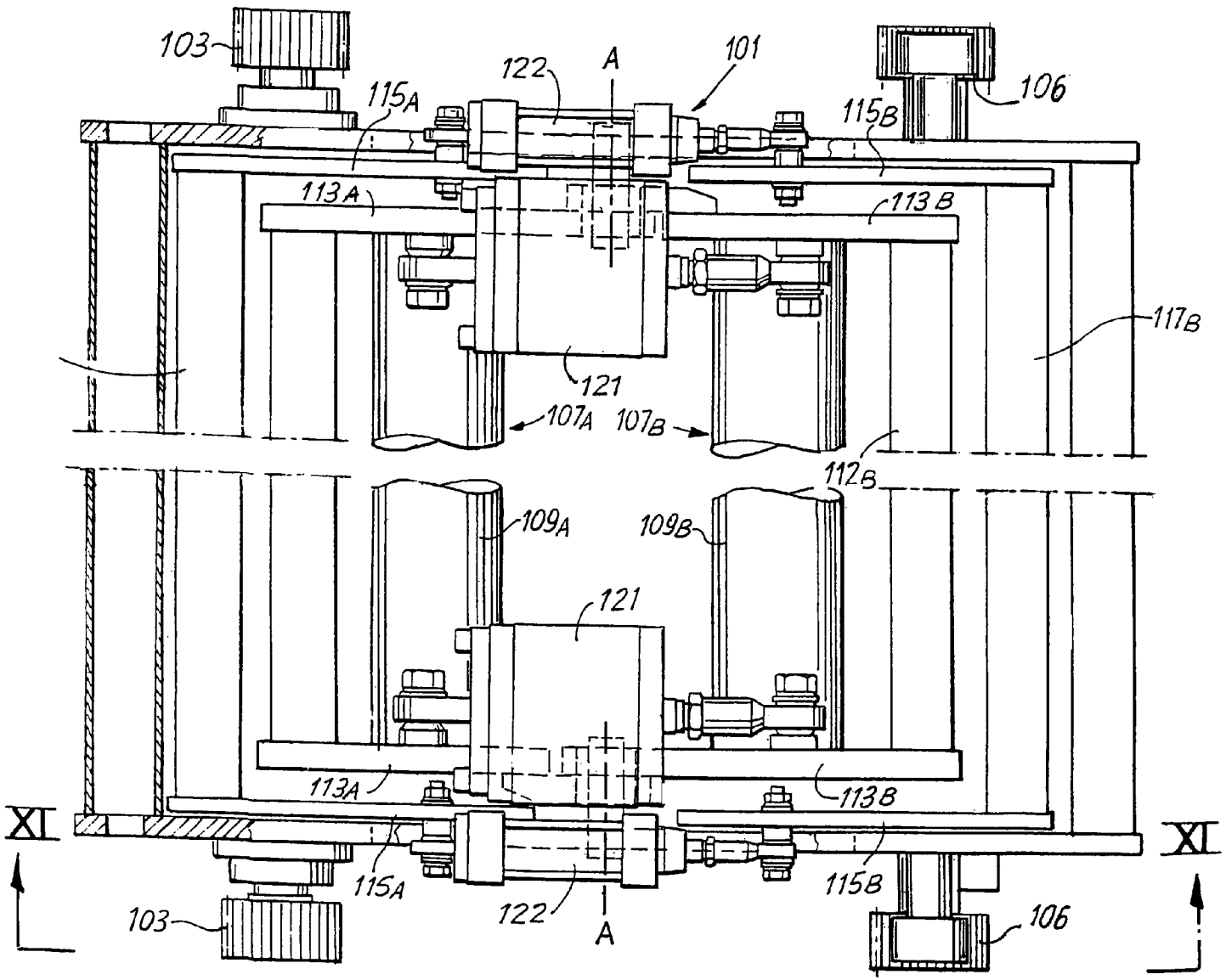
FIG. 10 shows a plane view according to X-X in FIG. 11 of the upper half-heads.
Figure 11:
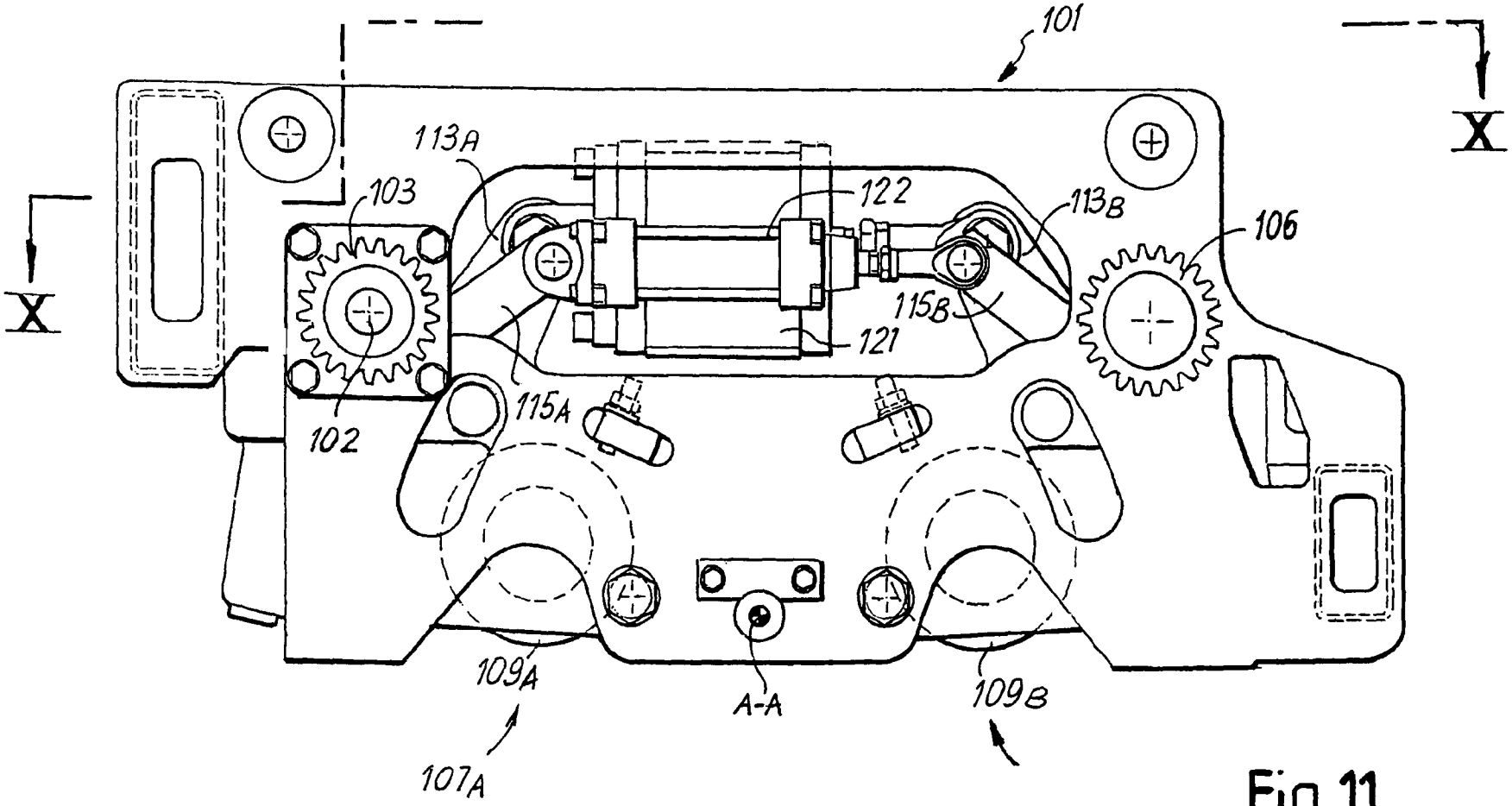
FIG. 11 shows a front view according to XI-XI in FIG. 10.

FIGS. 8A to 8C show the phase to prepare a leading edge of a web material for subsequent splicing. The specific example shows preparation of the edge of web material NC to pre-position the unwinding device to perform the subsequent splicing operation of the web NB and the web NC (FIGS. 3-4).

Disposed at the side of each of the rollers 129A, 129B is a trimming channel to trim the leading edge of the web material. This channel is indicated with 161A, 161B for the two lower half-heads. In FIG. 8A the channel 161B is used to trim the initial edge of the web material NC. This operation is performed manually by an operator using a shoe knife or other suitable tool, although it would also be possible to perform this operation automatically. Disposed adjacent to the channel 161B is a supporting surface 163B (indicated with 163A in the case of the half-head 127A) which facilitates the operation to apply the strip of double-sided adhesive AD to the trimmed free edge of the web material NC.

Before performing trimming of the web material NC along the edge of the channel 161B, the web material is temporarily clamped against the surface of the roller 129B by a temporary clamping surface 167B advantageously coated in a material with a high coefficient of friction (for example rubber) and carried by shaped oscillating arms 169B hinged about an axis 171B to the oscillating arms 137B. Oscillation of the temporary clamping surface 167B is controlled by a piston-cylinder actuator 173B, connected to the surface 167B and to the arms 137B. A symmetrical arrangement of members is provided on the lower half-head 127A, as can be seen in FIGS. 5, 7A-7I, and indicated therein with the same reference numbers followed by the letter A.

From the position in FIG. 8A the temporary clamping surface 167B is made to oscillate clockwise (in the figure) by the actuator 173B to pinch the web material NC against the cylindrical surface of the roller 129B. Upon reaching this position, shown in FIG. 8B, the web material NC is temporarily held in position and can be trimmed.

Subsequently, the piston-cylinder actuator 135B retracts and carries the roller 129B against the clamping bar 143B, 145B in the position in FIG. 8C. The layout of the roller 129B, of the arms 137B, of the axis 133B and of the temporary clamping surface 167B is such that the roller 129B rolls on the surface 167B during this closing operation against the bar 143B, 145B. This rolling causes retraction of the trimmed free edge of the web material NC, which is thus positioned in proximity to the counter-blade 147B, with the double-sided adhesive strip AD in the correct position to cause (with a cycle specular to the one described with reference to FIGS. 7A-7D) adhesion of the leading edge of the web material NC to the tail of the web material NB by the splicing device head formed by the upper half-head 7B and by the lower half-head 127B. The phase to prepare the free leading edge on the lower half-head 127A occurs in a manner specular to the one shown for the half-head 127B with reference to FIGS. 8A-8C.

Figure 12:
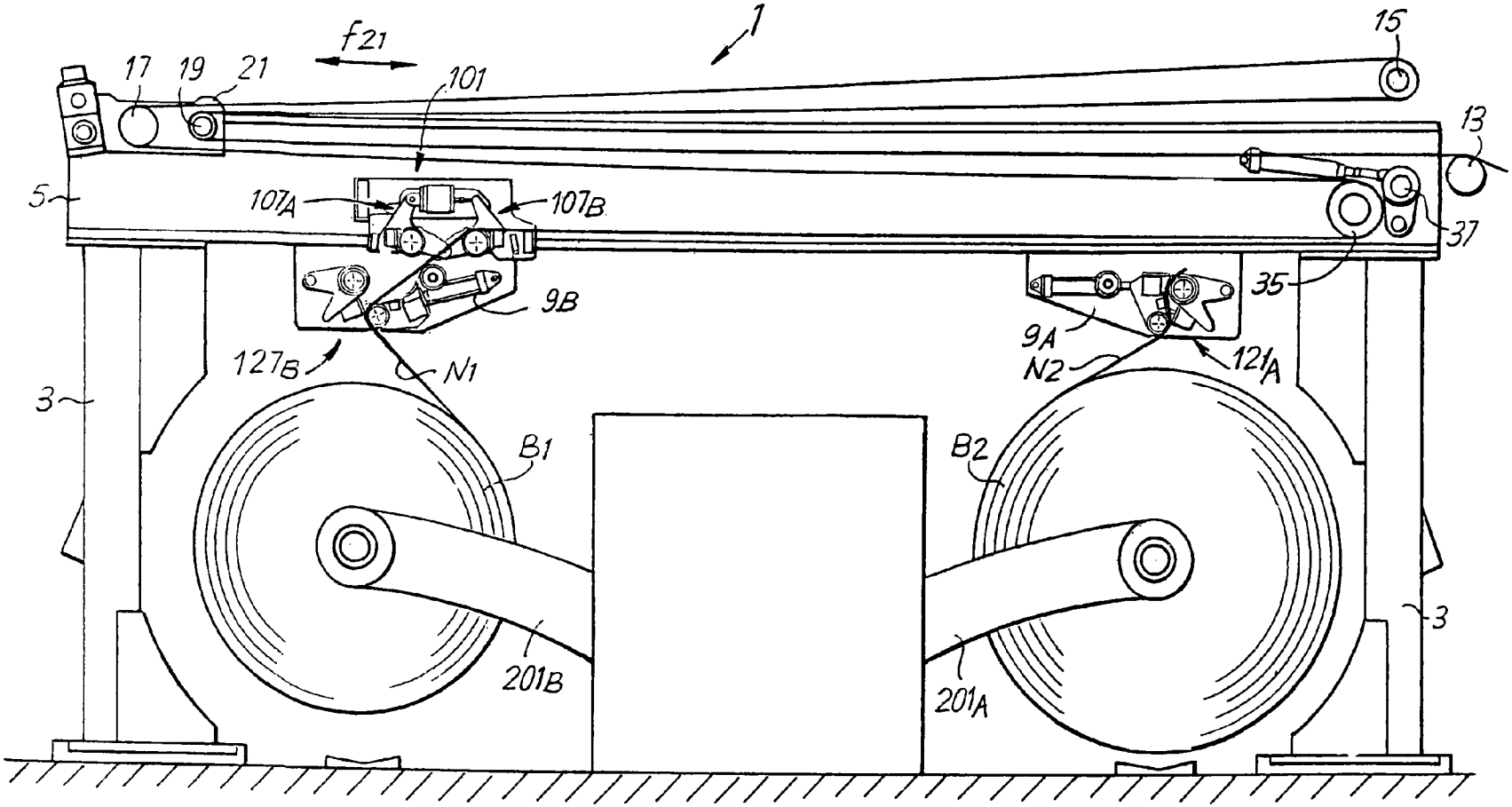
FIG. 12 shows a schematic front view of a different type of unwinding device with which a splicing device according to the invention is associated.

Hereinbefore the invention has been described with reference to an automatic unwinding device with three stations, with a solution wherein all the half-heads of the splicing device are movable along the crosspieces 5 to follow the movements of the supporting arms of the reels. Nonetheless, the invention may also be applied to unwinding devices with a simpler architecture, as indicated schematically in FIG. 12. Identical or equivalent parts to those in the previous figures are indicated with the same reference numbers. In this case the unwinding device is provided with two pairs of oscillating arms 201A, 201B, instead of three pairs of translating arms. Each pair supports a reel. In FIG. 12 the pair 201B carries the reel B1 which is in the unwinding phase, while the pair 201A carries the reel B2 pre-positioned for replacement. The web material N1 is supplied by the reel B1 while the leading edge of the web material N2 is pre-positioned for splicing on a lower half-head 127A, essentially equal to the lower half-head 127A shown in the previous figures. However, unlike the previous embodiment, in this case the lower half-head 127A is mounted on plates 9A fixed with respect to the crosspiece 5, instead of movable therealong.

Analogously, a lower half-head 127B is provided on the left of the unwinding device (in the drawing), carried by plates 9B fixed with respect to the crosspiece 5.

A carriage 101, essentially analogous to the carriage 101 described with reference to FIGS. 1-11 and carrying the two upper half-heads 107A, 107B, which cooperate with the lower half-heads 127A, 127B, translates along the crosspiece 5.

The cycles to splice and prepare the head edges of the web materials are essentially identical to those described hereinbefore, except for the fact that the lower half-heads 127A, 127B do not translate, while the carriage 101 translates according to the double arrow f101 from the position in FIG. 12 to the symmetrical position overlying the lower half-head 127A when the tail of the web material N1 is to be spliced with the head of the web material N2.

It is understood that the drawing merely shows an example provided purely as a practical embodiment of the invention, which may vary in forms and layouts without however departing from the scope of the concept on which the invention is based. Any reference numerals in the appended claims are provided purely to facilitate reading of the claims with reference to the description and to the drawing, and do not limit the scope of protection represented by the claims.

What I claim is:

1. An unwinding device comprising two pairs of uprights; a pair of crosspieces; on said crosspieces guides for a pair of carriages carrying vertical arms with tailstocks for axially engaging reels of web material; a splicing device for splicing together a first web material coming from a first reel being fed and a second web material, coming from a reel standing by; wherein said splicing device includes two heads, each one of said two heads having a lower half-head and an upper half-head; and wherein each said lower half-head of said two heads is supported on a different respective one of said pair of carriages; and the two upper half-heads are supported by a common slide moving along said crosspieces.

2. Unwinding device according to claim 1, wherein each said lower half-head includes a roller associated with a clamping bar to hold an initial edge of the second web material; each said upper half-head including a counter-pressure member cooperating with said roller to press said first web material and said second web material against each other; and a cutting member.

3. Unwinding device according to 1, wherein said counter-pressure member and said cutting member of each one of said heads are carried by a moving unit oscillating about an axis.

4. Unwinding device according to claim 3, further comprising control members which control movement of each said moving unit of said heads; and wherein said control members cause by movement imparted thereby to the moving unit of one or other head of said heads alternately: pinching of the first web material and the second web material between the roller and the counter-pressure member, cutting of the first web material, and release of the second web material.

5. Unwinding device according to claim 3, wherein each said moving unit of the heads are disposed essentially symmetrically with respect to a plane of symmetry.

* * * * *

UNITED STATES PATENT AND TRADEMARK OFFICE

CERTIFICATE OF CORRECTION

PATENT NO. : 8,011,409 B2
APPLICATION NO. : 12/232705
DATED : September 6, 2011
INVENTOR(S) : Mauro Adami It is certified that error appears in the above-identified patent and that said Letters Patent is hereby corrected as shown below:

In the claims:

Column 12:
Claim 3, line 23, “according to 1” should read -- according to 2 --.

Signed and Sealed this
Sixteenth Day of October, 2012

David J. Kappos
*Director of the United States Patent and Trademark Office*